US006435949B1

(12) United States Patent
Katsuoka et al.

(10) Patent No.: US 6,435,949 B1
(45) Date of Patent: Aug. 20, 2002

(54) WORKPIECE POLISHING APPARATUS COMPRISING A FLUID PRESSURE BAG PROVIDED BETWEEN A PRESSING SURFACE AND THE WORKPIECE AND METHOD OF USE THEREOF

(75) Inventors: Seiji Katsuoka, Atsugi; Hozumi Yasuda; Tadakazu Sone, both of Fujisawa; Shunichiro Kojima; Manabu Tsujimura, both of Yokohama, all of (JP)

(73) Assignee: Ebara Corporation, Tokyo (JP)

( * ) Notice: Subject to any disclaimer, the term of this patent is extended or adjusted under 35 U.S.C. 154(b) by 76 days.

(21) Appl. No.: 09/652,148

(22) Filed: Aug. 31, 2000

(30) Foreign Application Priority Data

Oct. 15, 1999 (JP) ..... 11-294503

(51) Int. Cl.[7] ..... B24B 1/00; B24B 29/00

(52) U.S. Cl. ..... 451/59; 451/288; 451/290; 451/398

(58) Field of Search ..... 451/41, 59, 63, 451/285, 286, 287, 288, 289, 290, 397, 398

(56) References Cited

U.S. PATENT DOCUMENTS 5,584,751 A * 12/1996 Kobayashi et al. ..... 451/287
5,820,448 A * 10/1998 Shamouilian et al. ..... 451/285
5,851,140 A * 12/1998 Barns et al. ..... 451/288
5,908,530 A 6/1999 Hoshizaki et al.
5,931,725 A * 8/1999 Inaba et al. ..... 451/288
5,938,884 A 8/1999 Hoshizaki et al.
5,964,653 A 10/1999 Perlov et al.
6,050,882 A * 4/2000 Chen ..... 451/285
6,290,584 B1 * 9/2001 Kim et al. ..... 451/288

FOREIGN PATENT DOCUMENTS

| | | |
|---|---|---|
| EP | 747 167 | 12/1996 |
| EP | 870 576 | 10/1998 |
| EP | 881 039 | 12/1998 |

* cited by examiner

*Primary Examiner*—Timothy V. Eley
(74) *Attorney, Agent, or Firm*—Wenderoth, Lind & Ponack, L.L.P.

(57) ABSTRACT

A polishing apparatus is used for polishing a workpiece such as a semiconductor wafer to a flat mirror finish. The polishing apparatus comprises a turntable having a polishing surface, a top ring for holding a workpiece and pressing the workpiece against the polishing surface, a holding surface of the top ring for holding the workpiece, and a retainer ring for retaining the workpiece within the holding surface of the top ring. The holding surface is deformable by fluid having variable pressure, and the retainer ring presses the polishing surface under a variable pressing force.

8 Claims, 20 Drawing Sheets

$F_1 > F_2$ $F_1 \fallingdotseq F_2$ $F_1 < F_2$

WORKPIECE POLISHING APPARATUS COMPRISING A FLUID PRESSURE BAG PROVIDED BETWEEN A PRESSING SURFACE AND THE WORKPIECE AND METHOD OF USE THEREOF

BACKGROUND OF THE INVENTION

1. Field of the Invention

The present invention relates to an apparatus and method for polishing workpiece, and more particularly to an apparatus and method for polishing a workpiece such as a semiconductor wafer to a flat mirror finish.

2. Description of the Related Art

Recent rapid progress in semiconductor device integration demands smaller and smaller wiring patterns or interconnections and also narrower spaces between interconnections which connect active areas. One of the processes available for forming such interconnection is photolithography. The photolithographic process requires that surfaces on which pattern images are to be focused by a stepper be as flat as possible because the depth of focus of the optical system is relatively small. It is therefore necessary to make the surfaces of semiconductor wafers flat for photolithography. One customary way of flattening the surfaces of semiconductor wafers is to polish them with a polishing apparatus.

Conventionally, a polishing apparatus has a turntable having a polishing cloth attached thereon, and a top ring for applying a constant pressure on the turntable. A semiconductor wafer to be polished is placed on the polishing cloth and clamped between the top ring and the turntable, and the surface of the semiconductor wafer on which circuits are formed is chemically and mechanically polished, while supplying a polishing liquid onto the polishing cloth. This process is called chemical mechanical polishing (CMP).

The polishing apparatus is required to have such performance that the surfaces of semiconductor wafers have a highly accurate flatness. Therefore, it is considered that the holding surface, i.e. the lower end surface of the top ring which holds a semiconductor wafer, and the upper surface of the polishing cloth which is held in contact with the semiconductor wafer, and hence the surface of the turntable to which the polishing cloth is attached, preferably have a highly accurate flatness, and the holding surface and the surface of the turntable which are highly accurately flat have been used. It is also considered that the lower surface of the top ring and the upper surface of the turntable are preferably parallel to each other, and such parallel surfaces have been used.

It is known that the polishing action of the polishing apparatus is affected not only by the configurations of the holding surface of the top ring and the contact surface of the polishing cloth, but also by the relative velocity between the polishing cloth and the semiconductor wafer, the distribution of pressure applied to the surface of the semiconductor wafer which is being polished, the amount of the polishing liquid on the polishing cloth, and the period of time when the polishing cloth has been used. It is considered that the surface of the semiconductor wafer can be highly accurately flat if the above factors which affect the polishing action of the polishing apparatus are equalized over the entire surface of the semiconductor wafer to be polished.

However, some of the above factors can easily be equalized over the entire surface of the semiconductor wafer, but the other factors cannot be equalized. For example, the relative velocity between the polishing cloth and the semiconductor wafer can easily be equalized by rotating the turntable and the top ring at the same rotational speed and in the same direction. However, it is difficult to equalize the amount of the polishing liquid on the polishing cloth because of a centrifugal forces imposed on the polishing liquid.

The above approach which tries to equalize all the factors affecting the polishing action, including the flatnesses of the lower end surface, i.e. the holding surface of the top ring and the upper surface of the polishing cloth on the turntable, over the entire surface of the semiconductor wafer to be polished poses limitations on efforts to make the polished surface of the semiconductor wafer flat, often resulting in a failure to accomplish a desired degree of flatness of the polishing surface. According to the study of the inventors, it is found that the lower surface (holding surface) of the top ring and the polishing surface of the turntable are preferably not parallel and flat.

SUMMARY OF THE INVENTION

It is therefore an object of the present invention to provide an apparatus and method for polishing a workpiece which can easily correct irregularities of a polishing action on a workpiece such as a semiconductor wafer, and polish a workpiece with an intensive polishing action or a weak polishing action on a desired localized area thereof.

In order to achieve the above object, according to a first aspect of the present invention, there is provided an apparatus for polishing a workpiece, the apparatus comprising: a turntable having a polishing surface; a top ring for holding a workpiece and pressing the workpiece against the polishing surface; a holding surface of the top ring for holding the workpiece, the holding surface being deformable by fluid having variable pressure; and a retainer ring for retaining the workpiece within the holding surface of the top ring, the retainer ring pressing the polishing surface under a variable pressing force.

According to another aspect of the present invention, there is provided a method for polishing a workpiece, the method comprising: holding a workpiece between a polishing surface of a turntable and a holding surface of a top ring; pressing the workpiece against the polishing surface in such a state that the holding surface for holding the workpiece is deformed to a desired shape by fluid having variable pressure; and pressing a retainer ring for retaining the workpiece within the holding surface of the top ring against the polishing surface under a variable pressing force.

FIG. 1 shows the basic principles of the first aspect of present invention. As shown in FIG. 1, the top ring 1 comprises a top ring body 2, and a holding plate 3 for holding a workpiece, to be polished, such as a semiconductor wafer 4. A chamber C is defined between the top ring body 2 and the holding plate 3, and is connected to a fluid source 5 through a regulator $R_1$. An elastic pad 6 of polyurethane or the like is attached to the lower surface of the holding plate 3. A retainer ring (guide ring) 7 for holding the semiconductor wafer 4 on the lower surface, i.e. the wafer holding surface 3*a* of the holding plate 3 is disposed around the outer peripheral portion of the top ring 1. A fluid pressure bag 8 comprising an annular tube is provided between the retainer ring 7 and the top ring 1. The fluid pressure bag 8 is connected to the fluid source 5 through a regulator $R_2$. A turntable 22 having a polishing cloth 21 attached thereon is disposed below the top ring 1. The polishing cloth 21 constitutes a polishing surface which is brought in sliding contact with the semiconductor wafer 4 for thereby polishing the semiconductor wafer 4.

The top ring 1 is connected to a top ring shaft 12 through a ball 11. The top ring shaft 12 is connected to a fluid pressure cylinder 14 fixedly mounted on a top ring head 13. The fluid pressure cylinder 14 serves as an actuator for moving the top ring 1 vertically, and is connected to the fluid source 5 through a regulator $R_3$.

In the above structure, by supplying a pressurized fluid such as a compressed air to the fluid pressure cylinder 14 from the fluid source 5, the top ring 1 presses the semiconductor wafer 4 to be polished against the polishing cloth 21 on the turntable 22 under a certain pressing force $F_1$ for thereby polishing the semiconductor wafer 4. The pressing force $F_1$ is variable by regulating the regulator $R_3$.

FIG. 2 is a schematic view showing the configuration of the wafer holding surface 3*a* of the holding plate 3. In FIG. 2, the horizontal axis represents a distance (mm) from the center (O) of the holding plate 3, and the vertical axis represents a height of the wafer holding surface. In FIG. 2, alternate long and short dash line "d" shows the condition that the wafer holding surface 3*a* is flat. In this condition, no pressurized fluid is supplied to the chamber C, and the polishing pressure is not applied to the wafer holding surface 3*a* while polishing is not performed. During polishing, when a pressurized fluid such as a compressed air is supplied to the chamber C from the fluid source 5, the wafer holding surface 3*a* of the holding plate 3 is curved by a pressing force of the pressurized fluid in a convex shape in a downward direction as shown by the curve "a" in FIG. 2. That is, the wafer holding surface 3*a* defines a convex spherical surface. In this condition, the central portion of the semiconductor wafer 4 is pressed by the downwardly convex holding plate 3 against the polishing cloth 21 in a pressure higher than that applied onto the outer circumferential portion thereof. Thus, if the amount of a material removed from the outer circumferential portion of the semiconductor wafer 4 is larger than the amount of a material removed from the central portion of the semiconductor wafer 4, insufficient polishing action at the central portion of the semiconductor wafer can be corrected by utilizing deformation of the holding plate 3 caused by the pressurized fluid.

On the other hand, if the amount of a material removed from the central portion of the semiconductor wafer 4 is larger than the amount of a material removed from the outer circumferential portion of the semiconductor wafer 4, the regulator $R_1$ is controlled to reduce the pressure of the pressurized fluid supplied from the fluid source 5 to the chamber C or to stop the supply of the pressurized fluid to the chamber C, thereby making the wafer holding surface 3*a* of the holding plate 3 in the form of curve "b" or "c" shown in FIG. 2. Therefore, the polishing pressure applied to the central portion of the semiconductor wafer 4 is decreased and the polishing pressure applied to the outer circumferential portion of the semiconductor wafer 4 is increased, in comparison with the condition caused by the curve "a". Thus, insufficient polishing action at the outer circumferential portion of the semiconductor wafer can be corrected, and the entire surface of the semiconductor wafer 4 can be uniformly polished.

When the supply of the pressurized fluid to the chamber C is stopped, the wafer holding surface 3*a* is curved due to a polishing pressure in a slightly convex shape in an upward direction as shown by the curve "c". That is, the wafer holding surface 3*a* defines a concave spherical surface. If it is desirable to cause the wafer holding surface 3*a* of the holding plate 3 to curve upwardly in a higher degree than the condition shown by the curve "c", the chamber C may be evacuated by the fluid source 5 comprising a vacuum pump. The shape or configuration of the wafer holding surface 3*a* can be made downwardly convex (convex spherical surface) or upwardly convex (concave spherical surface) or flat by developing positive pressure (pressure higher than atmospheric pressure) or negative pressure (pressure lower than atmospheric pressure) in the chamber C. The wafer holding surface 3*a* of the holding plate 3 can be deformed in a desired shape by selecting material and thickness of the holding plate 3. Preferred materials to be selected for the holding plate are, in consideration of the environments in which the polishing apparatus is used, corrosion-resistant and elastic materials, for example, austenitic stainless steel (SUS 304, SUS 316, etc.), aluminium titan, or resin material such as polyphenylene sulfide (PPS) or polyethelethelketone (PEEK). Preferred thickness of the holding plate is, in consideration of the safety against the interior pressure of the chamber (preferably, not more than 0.1 MPa), in the range of 3 to 8 mm, and preferably about 5 mm in case of austenitic stainless steel. In case of other materials, the thickness should be selected on the basis of modulus of elasticity, while taking into consideration the safety.

In parallel with correcting the shape of the wafer holding surface 3*a* of the top ring 1, the retainer ring 7 presses the polishing cloth 21 under a pressing force $F_2$ by supplying a pressurized fluid such as a compressed air to the fluid pressure bag 8 from the fluid source 5.

In the present invention, the pressing force $F_1$ exerted by the top ring 1 for pressing the semiconductor wafer 4 against the polishing cloth 21 on the turntable 22 is variable, and the pressing force $F_2$ for pressing the retainer ring 7 against the polishing cloth 21 is also variable. These pressing forces $F_1$, $F_2$ are variable independently of each other. Therefore, the pressing force $F_2$ which is applied to the polishing cloth 21 by the retainer ring 7 can be changed depending on the pressing force $F_1$ which is applied by the top ring 1 to press the semiconductor wafer 4 against the polishing cloth 21.

Theoretically, if the pressing force $F_1$ which is applied by the top ring 1 to press the semiconductor wafer 4 against the polishing cloth 21 is equal to the pressing force $F_2$ which is applied to the polishing cloth 21 by the retainer ring 7, then the distribution of applied polishing pressures, which result from a combination of the pressing forces $F_1$, $F_2$, is continuous and uniform from the center of the semiconductor wafer 4 to its peripheral edge and further to an outer circumferential edge of the retainer ring 7 disposed around the semiconductor wafer 4. Accordingly, the peripheral portion of the semiconductor wafer 4 is prevented from being polished excessively or insufficiently.

FIGS. 3A through 3C schematically show how the polishing cloth 21 behaves when the relationship between the pressing force $F_1$ and the pressing force $F_2$ is varied. In FIG. 3A, the pressing force $F_1$ is larger than the pressing force $F_2$ ($F_1>F_2$). In FIG. 3B, the pressing force $F_1$ is nearly equal to the pressing force $F_2$ ($F_1 \approx F_2$). In FIG. 3C, the pressing force $F_1$ is smaller than the pressing force $F_2$ ($F_1<F_2$).

As shown in FIGS. 3A through 3C, when the pressing force $F_2$ applied to the polishing cloth 21 by the retainer ring 7 is progressively increased, the polishing cloth 21 pressed by the retainer ring 7 is progressively compressed, thus progressively changing its state of contact with the peripheral portion of the semiconductor wafer 4, i.e., progressively reducing its area of contact with the peripheral portion of the semiconductor wafer 4. Therefore, when the relationship between the pressing force $F_1$ and the pressing force $F_2$ is changed in various patterns, the distribution of polishing pressures on the semiconductor wafer 4 over its peripheral portion and inner region is also changed in various patterns.

As shown in FIG. 3A, when the pressing force $F_1$ is larger than the pressing force $F_2$ ($F_1>F_2$), the polishing pressure applied to the peripheral portion of the semiconductor wafer 4 is larger than the polishing pressure applied to the inner region of the semiconductor wafer 4, so that the amount of a material removed from the peripheral portion of the semiconductor wafer 4 is larger than the amount of a material removed from the inner region of the semiconductor wafer 4 while the semiconductor wafer 4 is being polished.

As shown in FIG. 3B, when the pressing force $F_1$ is substantially equal to the pressing force $F_2$ ($F_1 \approx F_2$), the distribution of polishing pressures is continuous and uniform from the center of the semiconductor wafer 4 to its peripheral edge and further to the outer circumferential edge of the retainer ring 7, so that the amount of a material removed from the semiconductor wafer 4 is uniform from the peripheral edge to the inner region of the semiconductor wafer 4 while the semiconductor wafer 4 is being polished.

As shown in FIG. 3C, when the pressing force $F_1$ is smaller than the pressing force $F_2$ ($F_1<F_2$), the polishing pressure applied to the peripheral portion of the semiconductor wafer 4 is smaller than the polishing pressure applied to the inner region of the semiconductor wafer 4, so that the amount of a material removed from the peripheral edge of the semiconductor wafer 4 is smaller than the amount of a material removed from the inner region of the semiconductor wafer 4 while the semiconductor wafer 4 is being polished.

As described above, according to the present invention, fluid is supplied to the upper surface opposite to the wafer holding surface 3*a* of the holding plate 3 of the rop ring 1, and, at this time, the pressure of the fluid is properly selected in the range of positive pressure to negative pressure to thereby make the shape of the wafer holding surface 3*a* downwardly convex or upwardly convex. In this connection, the semiconductor wafer 4 can be polished differently by varying the pressing force for pressing the semiconductor wafer 4 against the polishing cloth 21 at the outer circumferential portion and the central portion thereof. In some cases, the semiconductor wafer 4 is polished under the condition that the wafer holding surface 3*a* of the holding plate 3 is made flat.

In parallel with the above process, the pressing force $F_2$ of the retainer ring 7 disposed around the top ring 1 is determined on the basis of the pressing force $F_1$ of the top ring 1, and the polishing is performed while the retainer ring 7 presses the polishing cloth 21 under the determined pressing force $F_2$. That is, the polishing operation of the semiconductor wafer 4 is performed under the shape correcting effect of the wafer holding surface 3*a* by fluid having positive pressure or negative pressure as well as the shape correcting effect of the polishing cloth 21 by the retainer ring 7. Thus, irregularities of the polishing action can be sufficiently corrected and the localized area (for example, the central portion, the outer circumferential portion) of the semiconductor wafer 4 is prevented from being polished excessively or insufficiently.

Acording to a second aspect of the present invention, there is provided an apparatus for polishing a workpiece, the apparatus comprising: a turntable having a polishing surface; a top ring for holding a workpiece and pressing the workpiece against the polishing surface; a pressing surface of the top ring for pressing the workpiece, the pressing surface being deformable by fluid having variable pressure; a fluid pressure bag provided between the pressing surface and the workpiece; and a retainer ring for retaining the workpiece within the top ring, the retainer ring pressing the polishing surface under a variable pressing force.

According to another aspect of the present invention, there is provided a method for polishing a workpiece, the method comprising: holding a workpiece between a polishing surface of a turntable and a pressing surface of a top ring; pressing the workpiece against the polishing surface through a fluid pressure bag provided between the pressing surface and the workpiece in such a state that the pressing surface for pressing the workpiece is deformed to a desired shape by fluid having variable pressure; and pressing a retainer ring for retaining the workpiece within the top ring against the polishing surface under a variable pressing force.

According to the second aspect of the present invention, the top ring has characteristics of the top ring of diaphragm-type, defined in the first aspect of the present invention, having a structure in which a holding surface for holding the workpiece is deformable by fluid pressure, i.e. controllability of the distribution of pressure on the surface to be polished as well as characteristics of the top ring of membrane-type, disclosed in, for example, Japanese laid-open patent publication No. 5-69310, having a structure in which a membrane is provided, i.e. applicability of uniform pressure onto the backside of the workpiece. Specifically, this top ring can apply controlled pressure partially onto the outer circumferential portion or the central portion of the workpiece, and apply uniform pressure onto the entire surface of other portion. Further, this top ring can control the region (width) of the outer circumferential portion or the central portion of the workpiece to which pressure is applied.

According to another aspect of the present invention, there is provided an apparatus for polishing a workpiece, the apparatus comprising: a turntable having a polishing surface; a top ring for holding a workpiece and pressing the workpiece against the polishing surface; a holding surface of the top ring for holding the workpiece; a retainer ring for retaining the workpiece within the holding surface of the top ring; and a pressing mechanism for pressing the retainer ring against the pressing surface under a variable pressing force, the pressing mechanism comprising a ring member vertically movably provided, and a space for allowing fluid having variable pressure to be supplied to press the ring member against the retainer ring.

With the above arrangement, even if the retainer ring is worn, the pressing mechanism for pressing the retainer ring can press the retainer ring against the polishing surface under a desired pressing force.

The above and other objects, features, and advantages of the present invention will be apparent from the following description when taken in conjunction with the accompanying drawings which illustrates preferred embodiments of the present invention by way of example.

BRIEF DESCRIPTION OF THE DRAWINGS

FIG. 19A is the state of the top ring before the semiconductor wafer is held by the top ring and FIG. 19B is the state of the top ring after the semiconductor wafer is held by the top ring;

DETAILED DESCRIPTION OF THE PREFERRED EMBODIMENTS

Figure 4:
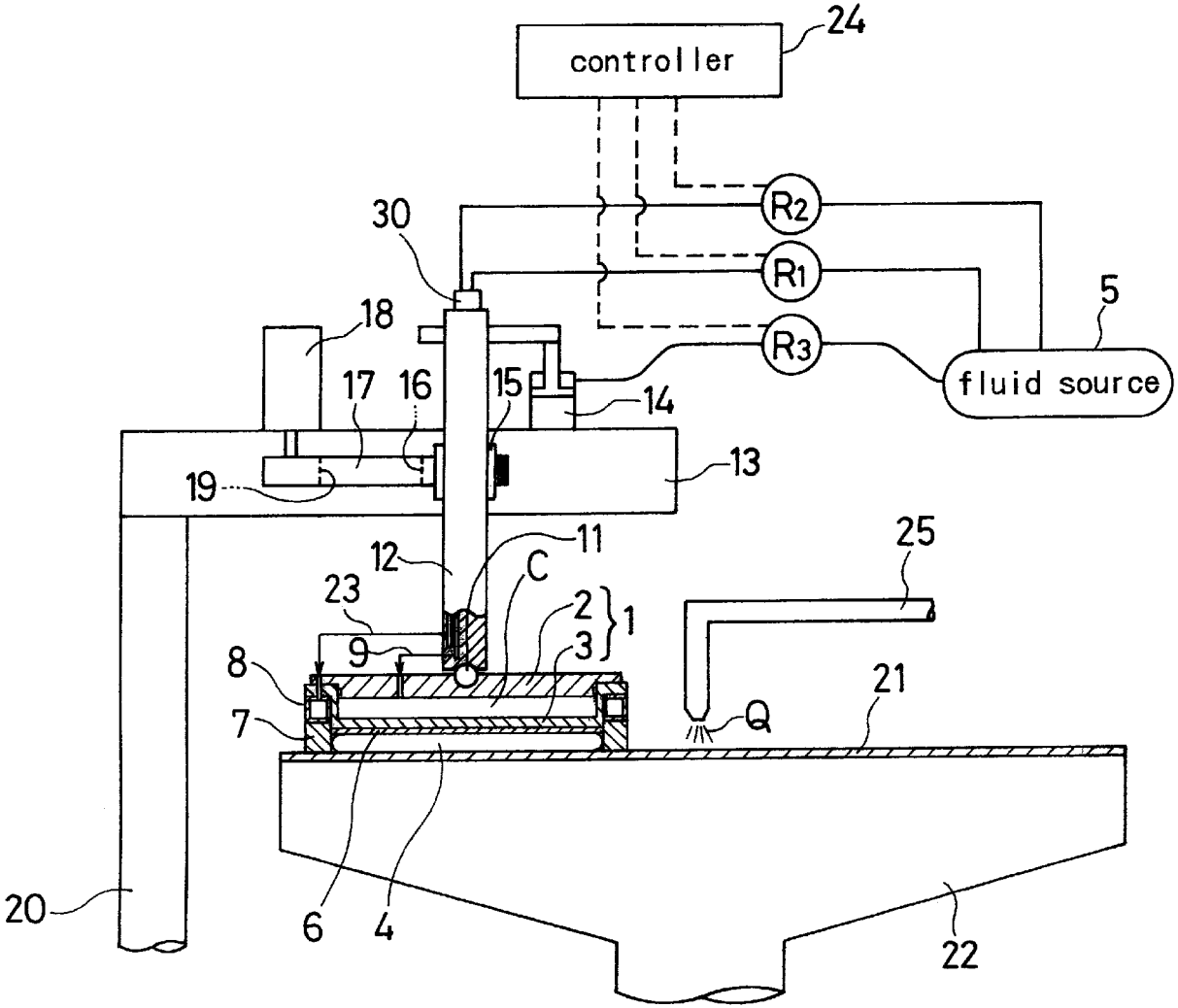
FIG. 4 is a schematic view showing a whole structure of a polishing apparatus according to an embodiment of the present invention.

Next, an apparatus and method for polishing workpiece according to an embodiment of the present invention will be described below with reference to FIGS. 4 and 5. FIG. 4 is a cross-sectional view showing the whole structure of the polishing apparatus according to an embodiment of the present invention, and FIG. 5 is a cross-sectional view showing the essential part of the polishing apparatus.

Figure 5:
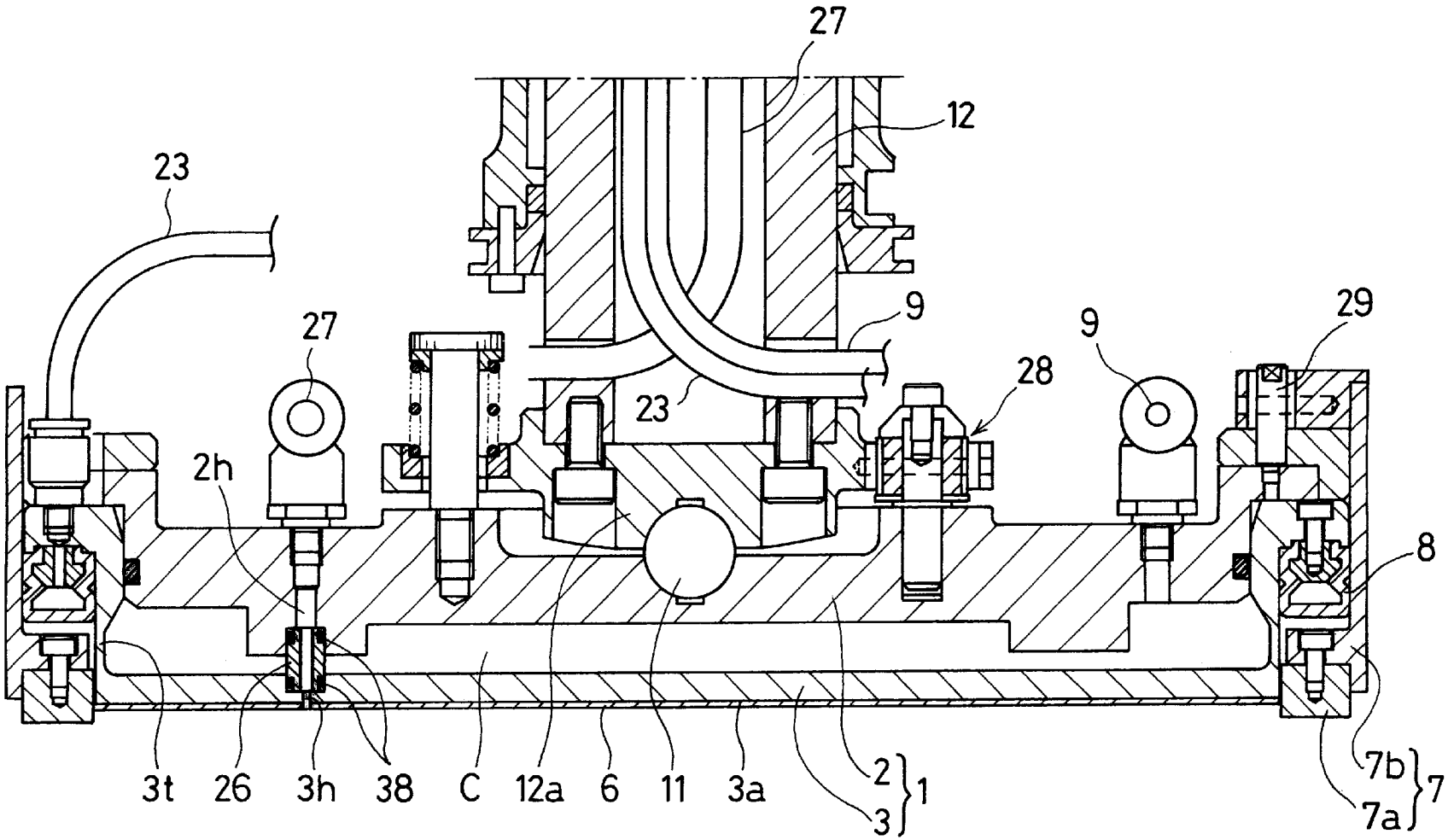
FIG. 5 is a cross-sectional view showing the structure of the essential part of the polishing apparatus according to the embodiment of the present invention.

As shown in FIGS. 4 and 5, a top ring 1 comprises a top ring body 2, and a holding plate 3 for holding an upper surface of the workpiece, to be polished, such as a semiconductor wafer 4. A chamber C is defined between the top ring body 2 and the holding plate 3, and is connected to a fluid source 5 through a regulator $R_1$. The holding plate 3 has a thin wall portion 3*t* at an intermedicate portion of the outer peripheral portion. The thin wall portion 3*t* allows the entire surface of the wafer holding surface 3*a* to be deformed uniformly when positive pressure or negative pressure is applied to the holding plate 3. A tube 9 is provided to connect the chamber C and the regulator $R_1$. An elastic pad 6 is attached to the lower surface of the holding plate 3.

A retainer ring (guide ring) 7 for holding the semiconductor wafer 4 on the lower surface, i.e. the wafer holding surface 3*a* of the holding plate 3 is disposed around the outer peripheral portion of the top ring 1. As shown in FIG. 5, the retainer ring 7 comprises a first retainer ring member 7*a* of resin material which is provided at the lowermost position and contacts the polishing cloth 21, and a second retainer ring member 7*b* having a L-shaped cross section which is provided on the first retainer ring member 7*a* and supports the first retainer ring member 7*a*. The second retainer ring member 7*b* is connected at its upper end to the top ring body 2 by a pin 29 in a rotational direction so that the retainer ring 7 is rotatable together with the top ring 1. A fluid pressure bag 8 comprising an annular tube is provided between the retainer ring 7 and the top ring 1. The fluid pressure bag 8 is fixed to the holding plate 3. The fluid pressure bag 8 is connected to the fluid source 5 through a regulator $R_2$. A tube 23 is provided to connect the fluid pressure bag 8 and the regulator $R_2$. A turntable 22 having a polishing cloth 21 attached thereon is disposed below the top ring 1. The polishing cloth 21 constitutes a polishing surface which is brought in sliding contact with the semiconductor wafer 4 for thereby polishing the semiconductor wafer 4.

The top ring 1 is connected to a top ring shaft 12 having a driving flange 12*a* through a ball 11. The top ring haft 12 is connected to a fluid pressure cylinder 14 fixedly mounted on a top ring head 13. The fluid pressure cylinder 14 serves as an actuator for moving the top ring 1 vertically, and is connected to the fluid source 5 through a regulator $R_3$. The ball 11 constitutes a gimbal mechanism which allows the top ring 1 to follow the tilting motion of the turntable 22.

Further, the top ring shaft 12 has an intermediate portion co-rotatably coupled to a rotatable cylinder 15 by means of a key (not shown), and the rotatable cylinder 15 has a timing pulley 16 mounted on its outer peripheral portion thereof. The timing pulley 16 is operatively coupled by a timing belt 17 to a timing pulley 19 mounted on a rotating shaft of a top ring motor 18. The top ring motor 18 is fixedly mounted on the top ring head 13. Therefore, when the top ring motor 18 is energized, the rotatable cylinder 15 and the top ring shaft 12 are rotated integrally through the timing pulley 19, the timing belt 17, and the timing pulley 16, and thus the top ring 1 is rotated. The rotation of the top ring shaft 12 is transmitted to the top ring 1 through a transmitting mechanism 28 including a plurality of pins. The top ring head 13 is supported by a top ring head shaft 20 fixedly mounted on a frame (not shown).

On the other hand, the retainer ring 7 is connected to the top ring 1 through the pin 29 and the fluid pressure bag 8, whereby the rotation of the top ring 1 is transmitted to the retainer ring 7 by the pin 29 and the retainer ring 7 is vertically moved by the fluid pressure bag 8. That is, the retainer ring 7 is vertially movable with respect to the top ring 1, and rotatable together with the top ring 1.

As described above, the chamber C is connected to the fluid source 5 through the regulator $R_1$. By regulating fluid pressure of fluid supplied to the chamber C with the regulator $R_1$, the shape of curvature (convex in a downward direction, or convex in an upward direction) of the wafer holding surface 3*a* of the holding plate 3 can be adjusted, and the degree of curvature can be also adjusted. The fluid pressure cylinder 14 and the fluid pressure bag 8 are connected to the fluid source 5 through regulators $R_3$, $R_2$, respectively. The chamber C is connected to the regulator $R_1$through a tube 9 extending in the top ring shaft 12 and a rotary joint 30, and the fluid pressure bag 8 is connected to the regulator $R_2$ through a tube 23 extending in the top ring shaft 12 and the rotary joint 30. The regulator $R_3$ regulates fluid pressure supplied from the fluid source 5 to the fluid pressure cylinder 14 to adjust the pressing force which is applied by the top ring 1 to press the semiconductor wafer 4 against the polishing cloth 21. The regulator $R_2$ also regulates fluid pressure supplied from the fluid source 5 to the fluid pressure bag 8 to adjust the pressing force which is applied by the retainer ring 7 to press the polishing cloth 21.

The regulators $R_1$, $R_2$, and $R_3$ are connected to a controller 24, and controlled in accordance with the input values of the controller 24. In this case, the regulator $R_1$ is controlled independently by the controller 24, and the regulators $R_2$ and $R_3$ are controlled in cooperation with each other. Specifically, when the retainer ring 7 is pressed against the polishing cloth 21, the retainer ring 7 is subjected to reactive forces which affect the pressing force applied by the top ring 1. To avoid such a problem, setpoints for the pressing forces to be applied by the top ring 1 and the retainer ring 7 are inputted to the controller 24, which calculates fluid pressures to be delivered to the fluid pressure cylinder 14 and the fluid pressure bag 8. The controller 24 then controls the regulators $R_2$, $R_3$ to supply the calculated fluid pressures to the fluid pressure cylinder 14 and the fluid pressure bag 8, respectively. Therefore, the top ring 1 and the retainer ring 7 can apply desired pressing forces to the semiconductor wafer 4 and the polishing cloth 21, respectively. The pressing forces applied by the top ring 1 and the retainer ring 7 can thus be changed independently of each other while the semiconductor wafer 4 is being polished.

As shown in FIG. 5, the holding plate 3 is provided with a plurality of communication holes 3*h* opening at the lower surface thereof. These communication holes 3*h* communicate with a vacuum source (not shown) such as a vacuum pump through joints 26, communication holes 2*h* formed in the top ring body 2, and tubes 27. Thus, the wafer holding surface 3*a* of the holding plate 3 holds the semiconductor wafer 4 under vacuum. Each of the joints 26 has a pair of O-rings 38 at upper and lower ends thereof to prevent the communication holes 2*h* and 3*h* from communicating with the chamber C. The joint 26 is inserted into the holding plate 3 in a clearance fit so as not to prohibit the holding plate 3 from being deformed. The communication holes 3*h* are connected to a switching valve (not shown) through a tube 27 extending in the top ring shaft 12 and a rotary joint 30. By switching the switching valve, the communication holes 3*h* are allowed to communicate with the vacuum source, a pressurized air source, or a liquid source. The semiconductor wafer 4 can be held by the wafer holding surface 3*a* of the holding plate 3 by developing negative pressure in the communication holes 3*h* by the vacuum source. Further, the backside pressure can be applied to the semiconductor wafer 4 by ejecting a pressurized air through the communication holes 3*h* by the pressurized air source. Traces formed during transportation of the semiconductor wafer by the effect of vacuum attraction can be eliminated by slightly applying the backside pressure on the semiconductor wafer 4 during polishing operation. The semiconductor wafer 4 can be removed from the wafer holding surface 3*a* by ejecting liquid through the communication holes 3*h* by the liquid source.

A polishing liquid supply nozzle 25 is provided above the turntable 22 to supply a polishing liquid Q onto the polishing cloth 21 on the turntable 22.

In the polishing apparatus having the above structure, the semiconductor wafer 4 is held by the wafer holding surface 3*a* of the holding plate 3, and the top ring 1 is pressed against the turntable 22. Thus, the semiconductor wafer 4 is pressed against the polishing cloth 21 on the turntable 22 which is rotating. By supplying the polishing liquid Q through the polishing liquid supply nozzle 25, the polishing liquid Q is retained on the polishing cloth 21. Therefore, the lower surface of the semiconductor wafer 4 is polished with the polishing liquid Q which is present between the lower surface of the semiconductor wafer 4 and the polishing cloth 21.

Figure 2:
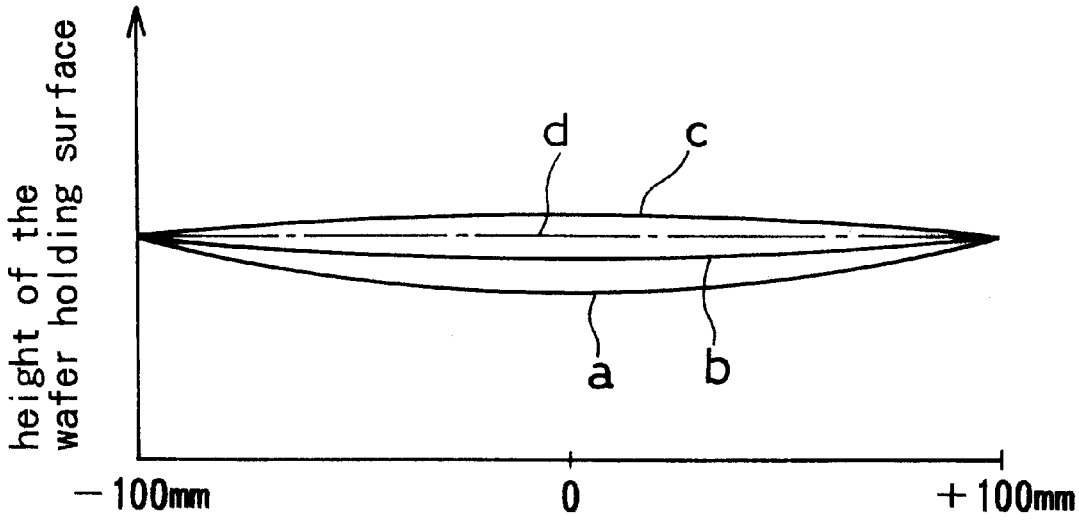
FIG. 2 is a graph showing the configuration of the wafer holding surface of the holding plate of the top ring.
Figure 3A:
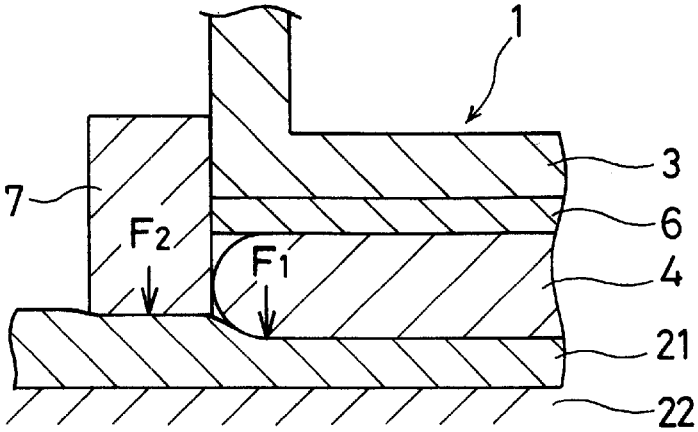
FIGS. 3A, 3B, and 3C are enlarged fragmentary vertical cross-sectional views showing the behavior of a polishing cloth when the relationship between a pressing force applied by a top ring and a pressing force applied by a retainer ring is varied.
Figure 3B:
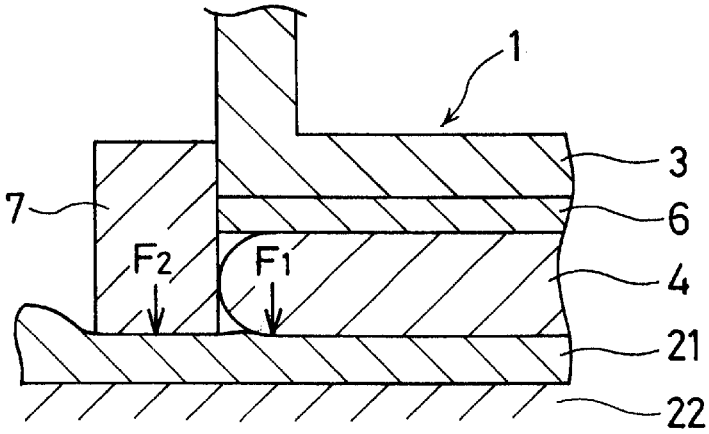
Figure 3C:
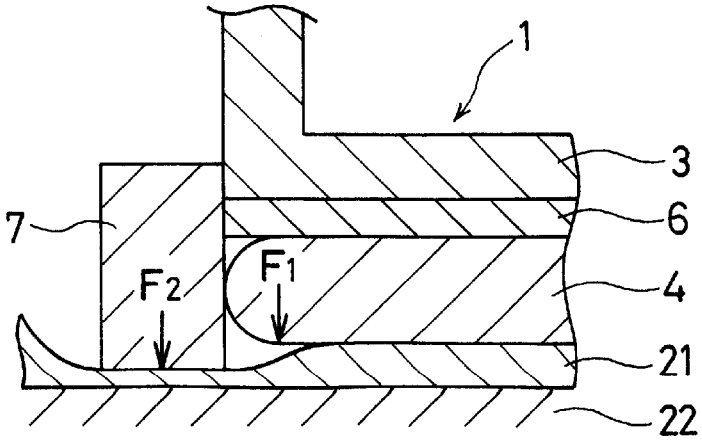

During polishing, when a pressurized fluid such as a compressed air is supplied to the chamber C from the fluid source 5, the wafer holding surface 3*a* is curved by a pressing force of the pressurized fluid in a convex shape in a downward direction as shown by the curve "a" in FIG. 2. That is, the wafer holding surface 3*a* defines a convex spherical surface. In this condition, the central portion of the semiconductor wafer 4 is pressed by the downwardly convex holding surface 3*a* against the polishing cloth 21 in a pressure higher than that applied onto the outer circumferential portion thereof. Thus, if the amount of a material removed from the outer circumferential portion of the semiconductor wafer 4 is larger than the amount of a material removed from the central portion of the semiconductor wafer 4, insufficient polishing action at the central portion of the semiconductor wafer can be corrected by utilizing deformation of the holding surface 3*a* of the holding plate 3 caused by the pressurized fluid.

On the other hand, if the amount of a material removed from the central portion of the semiconductor wafer 4 is larger than the amount of a material removed from the outer circumferential portion of the semiconductor wafer 4, the regulator $R_1$ is controlled to reduce the pressure of the pressurized fluid supplied from the fluid source 5 to the chamber C or to stop the supply of the pressurized fluid to the chamber C, thereby making the wafer holding surface 3*a* of the holding plate 3 in the form of curve "b" or "c" shown in FIG. 2. Thus, the polishing pressure applied to the central portion of the semiconductor wafer 4 is decreased and the polishing pressure applied to the outer circumferential portion of the semiconductor wafer 4 is increased. Thus, insufficient polishing action at the outer circumferential portion of the semiconductor wafer can be corrected, and the entire surface of the semiconductor wafer 4 can be uniformly polished.

In the present invention, the pressing force $F_1$ exerted by the top ring 1 for pressing the semiconductor wafer 4 against the polishing cloth 21 on the turntable 22 is variable, and the pressing force $F_2$ for pressing the retainer ring 7 against the polishing cloth 21 is also variable. These pressing forces $F_1$, $F_2$ are variable independently of each other. Therefore, the pressing force $F_2$ which is applied to the polishing cloth 21 by the retainer ring 7 can be changed depending on the pressing force $F_1$ which is applied by the top ring 1 to press the semiconductor wafer 4 against the polishing cloth 21.

Figure 1:
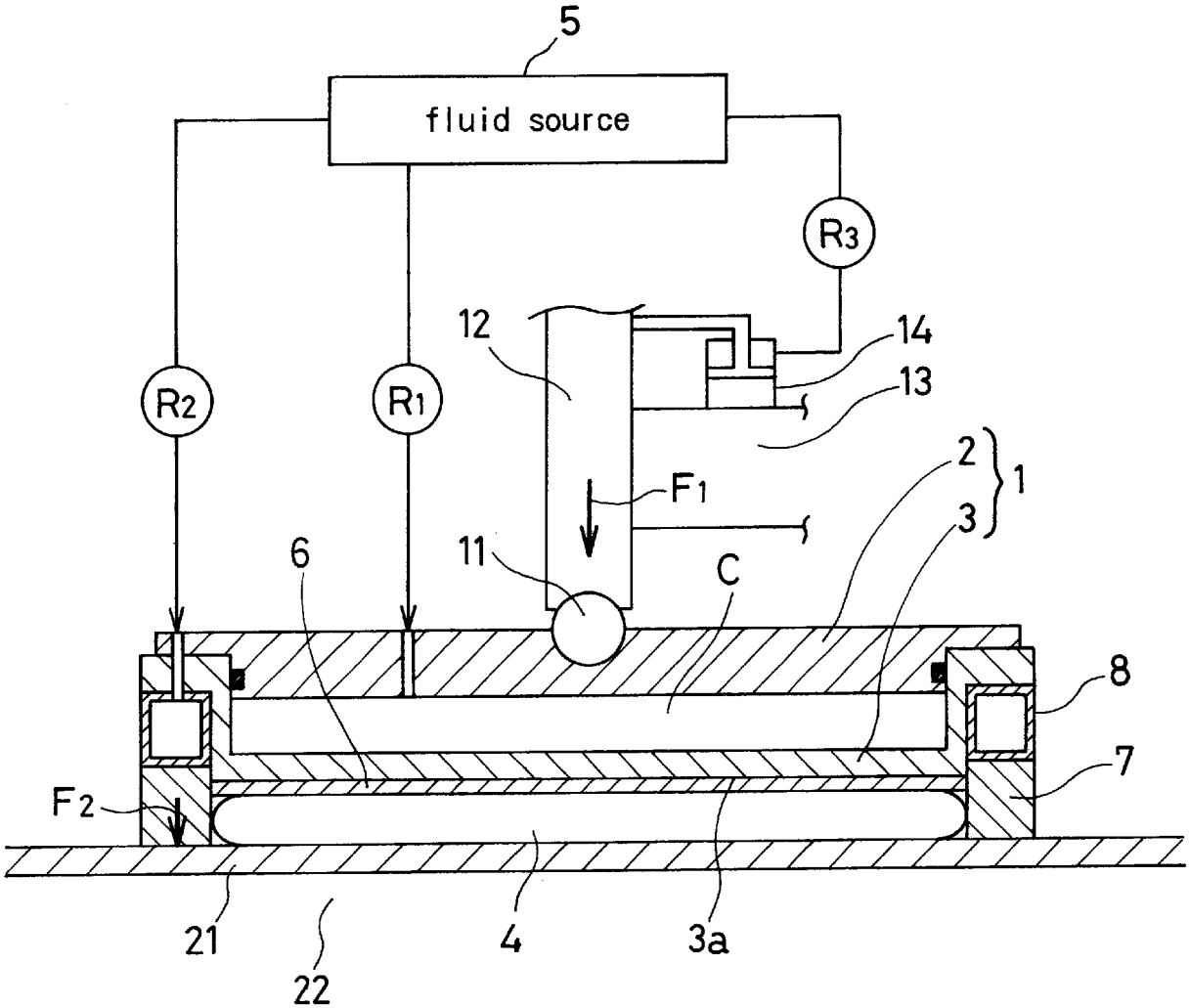
FIG. 1 is a schematic cross-sectional view showing the basic principles of the first aspect of the present invention.

Specifically, the pressing force $F_1$ exerted by the top ring 1 for pressing the semiconductor wafer 4 against the polishing cloth 21 on the turntable 22 can be changed by the regulator $R_3$, and the pressing force $F_2$ for pressing the retainer ring 7 against the polishing cloth 21 on the turntable 22 can be changed by the regulator $R_2$ (see FIG. 1). Therefore, during the polishing process, the pressing force $F_2$ applied by the retainer ring 7 to press the polishing cloth 21 can be changed depending on the pressing force $F_1$ applied by the top ring 1 to press the semiconductor wafer 4 against the polishing cloth 21. By adjusting the pressing force $F_2$ with respect to the pressing force $F_1$, the distribution of polishing pressures is made continuous and uniform from the center of the semiconductor wafer 4 to its peripheral edge and further to the outer circumferential edge of the retainer ring 7 disposed around the semiconductor wafer 4. Consequently, the central portion or the peripheral portion of the semiconductor wafer 4 is prevented from being polished excessively or insufficiently.

If a greater or smaller thickness of material is to be removed from the peripheral portion of the semiconductor wafer 4 than from the inner region of the semiconductor wafer 4, then the pressing force $F_2$ applied by the retainer ring 7 is selected to be of a suitable value based on the pressing force $F_1$ applied by the top ring 1 to intentionally increase or reduce the amount of a material removed from the peripheral portion of the semiconductor wafer 4.

Specifically, the semiconductor wafer 4 is polished under the cooperative action of the shape correcting effect of the wafer holding surface 3*a* by controlling fluid pressure supplied to the chamber C as well as the shape correcting effect of the polishing cloth 21 by the retainer ring 7. Thus, irregularities of the polishing action can be sufficiently corrected and the localized area (for example, the central portion, the outer circumferential portion) of the semiconductor wafer 4 is prevented from being polished excessively or insufficiently. Further, the polishing is performed in such a manner that the amount of material removed from the localized area (for example, the central portion or the outer circumferential portion) of the semiconductor wafer 4 can be intentionally increased or decreased.

During polishing, in order to detect the profile (configuration) of the surface being polished, a measuring instrument such as a thickness measuring device for measuring the thickness of a film (or layer) deposited on the semiconductor wafer 4 may be provided in the turntable 22. By inputting the measured values of the measuring instrument into the controller 24, the wafer holding surface 3*a* of the holding plate 3 can be changed in its configuration based on the measured values.

Figure 6:
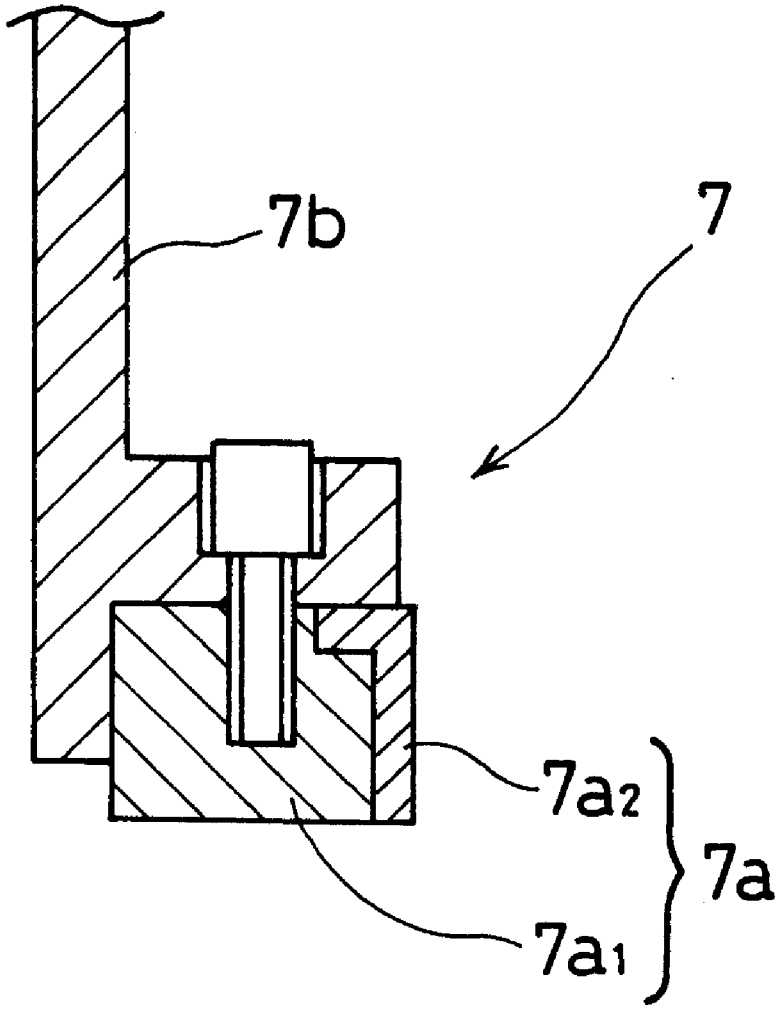
FIG. 6 is an enlarged cross-sectional view showing the retainer ring according to a modified embodiment of the present invention.

FIG. 6 is a cross-sectional view showing a modified embodiment of the retainer ring. The retainer ring 7 comprises a first retainer ring member 7*a* and a second retainer ring member 7*b*. The first retainer ring member 7*a* comprises a ring-shaped body $7a_1$ of ceramic material, and a ring-shaped contact portion $7a_2$ of resin material fixed to the inner peripheral surface of the ring shaped body $7a_1$ by adhesive or the like. Since the retainer ring 7 is formed by a combination of ceramic material and resin material, the ceramic material prolongs the service life of the retainer ring 7, and the resin material serving as a contact portion with the semiconductor wafer prevents the tipping of the semiconductor wafer.

Figure 7:
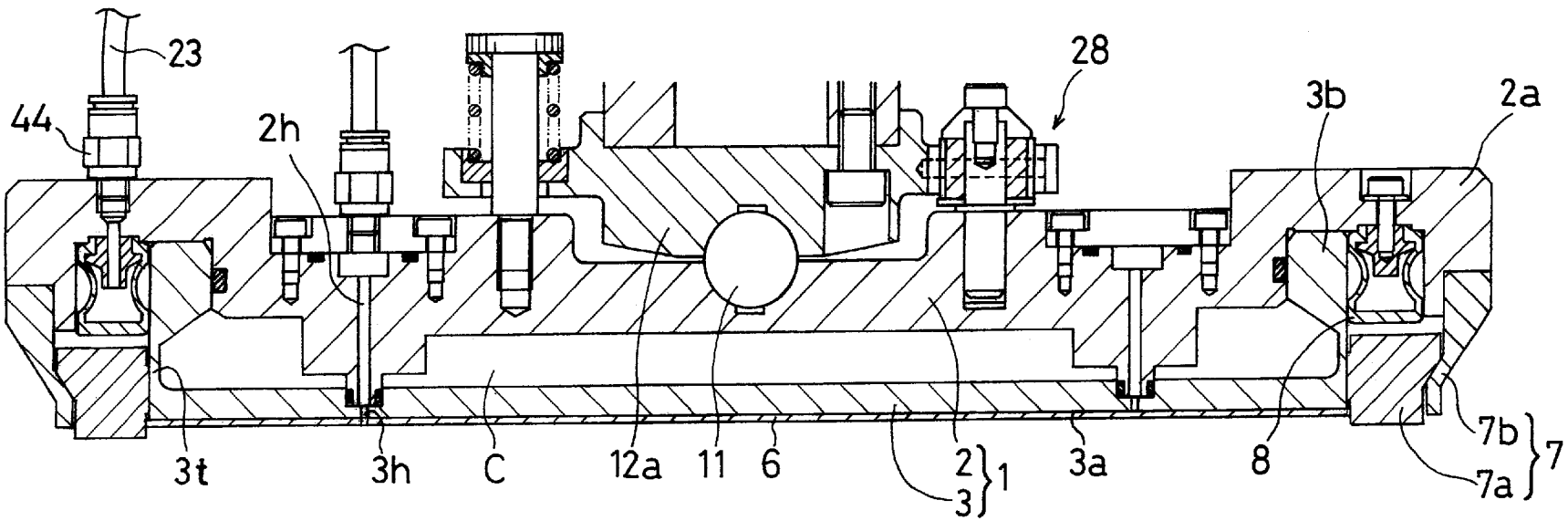
FIG. 7 is a cross-sectional view showing the essential part of the polishing apparatus according to another embodiment of the present invention.

FIG. 7 is a cross-sectional view showing the polishing apparatus according to another embodiment of the present invention. The top ring illustrated in FIG. 7 is different from that of FIG. 5 in the structure for mounting the retainer ring on the top ring. The top ring 1 comprises a top ring body 2, and a holding plate 3 for holding the upper surface of the semiconductor wafer 4 (see FIG. 4) as with the top ring shown in FIG. 5.

A retainer ring (guide ring) 7 for holding the semiconductor wafer 4 on the lower surface, i.e. the wafer holding surface 3*a* of the holding plate 3 is disposed around the outer peripheral portion of the top ring 1. The retainer ring 7 comprises a first retainer ring member 7*a* of resin material which is provided at the lowermost position and contacts the polishing cloth 21 (see FIG. 4), and a second retainer ring member 7*b* having a L-shaped cross section which is provided on the first retainer ring member 7*a* and supports the first retainer ring member 7*a* as in the embodiment shown in FIG. 5. The second retainer ring member 7*b* is connected at its upper end to an attachment flange portion 2*a* of the top ring body 2 so that the retainer ring 7 is rotatable together with the top ring 1, but is vertically movable with respect to the top ring 1. A fluid pressure bag 8 comprising an annular tube is provided in a groove defined between the attachment flange portion 2*a* provided at the outer peripheral portion of the top ring body 2 and the outer peripheral portion 3*b* of the holding plate 3. The fluid pressure bag 8 is fixed to the top ring body 2. Other structural and functional details of the polishing apparatus in this embodiment are identical to those of the polishing apparatus in the embodiment shown in FIG. 5.

Figure 8A:
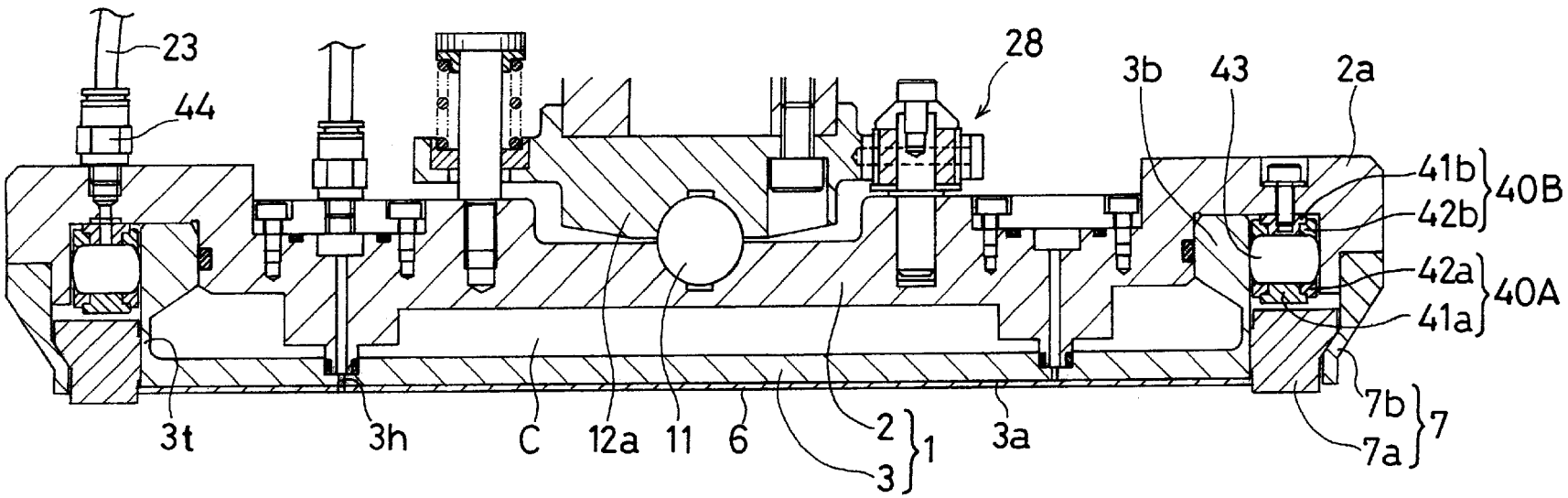
FIG. 8A is a cross-sectional view showing the polishing apparatus according to another embodiment of the present invention.
Figure 8B:
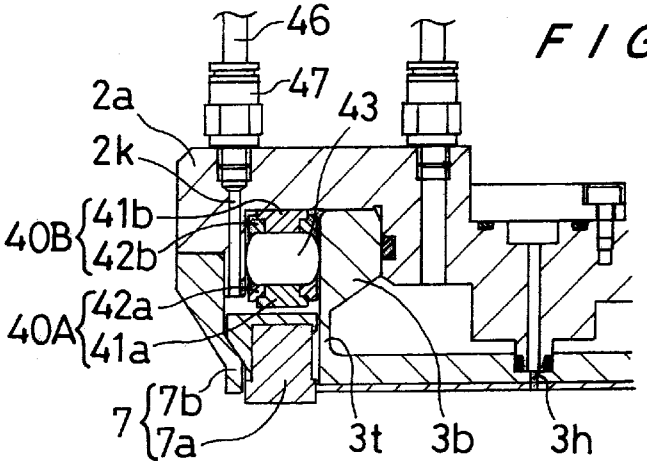
FIG. 8B is an enlarged cross-sectional view of the essential part of the polishing apparatus illustrated in FIG. 8A.
Figure 9A:
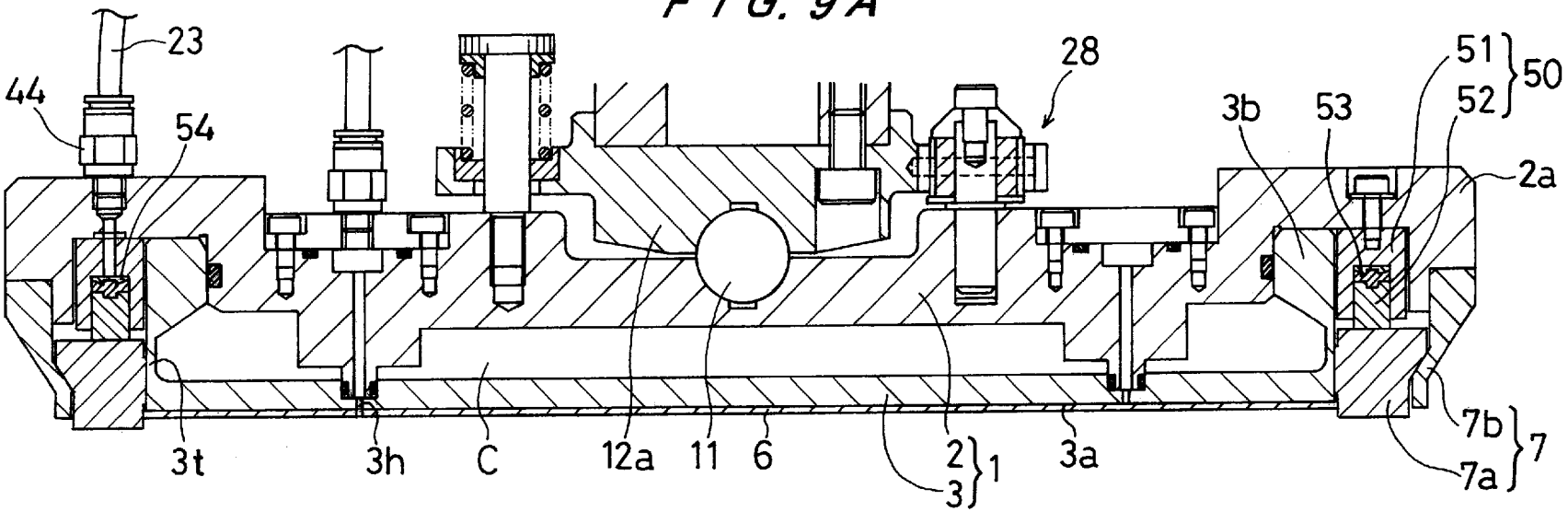
FIG. 9A is a cross-sectional view showing the polishing apparatus according to other embodiment of the present invention.
Figure 9B:
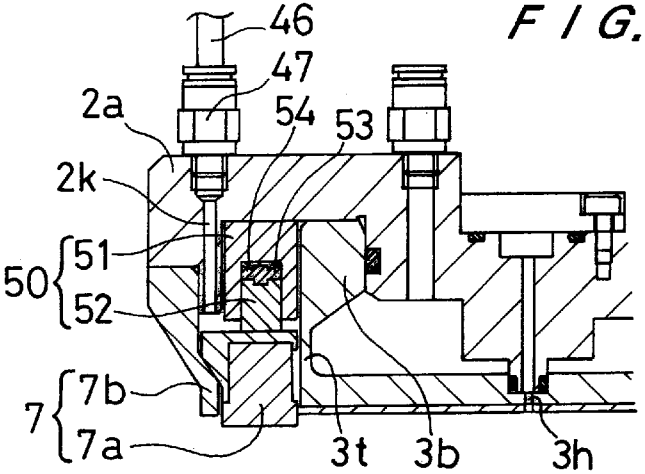
FIG. 9B is an enlarged cross-sectional view of the essential part of the polishing apparatus illustrated in FIG. 9A.
Figure 10A:
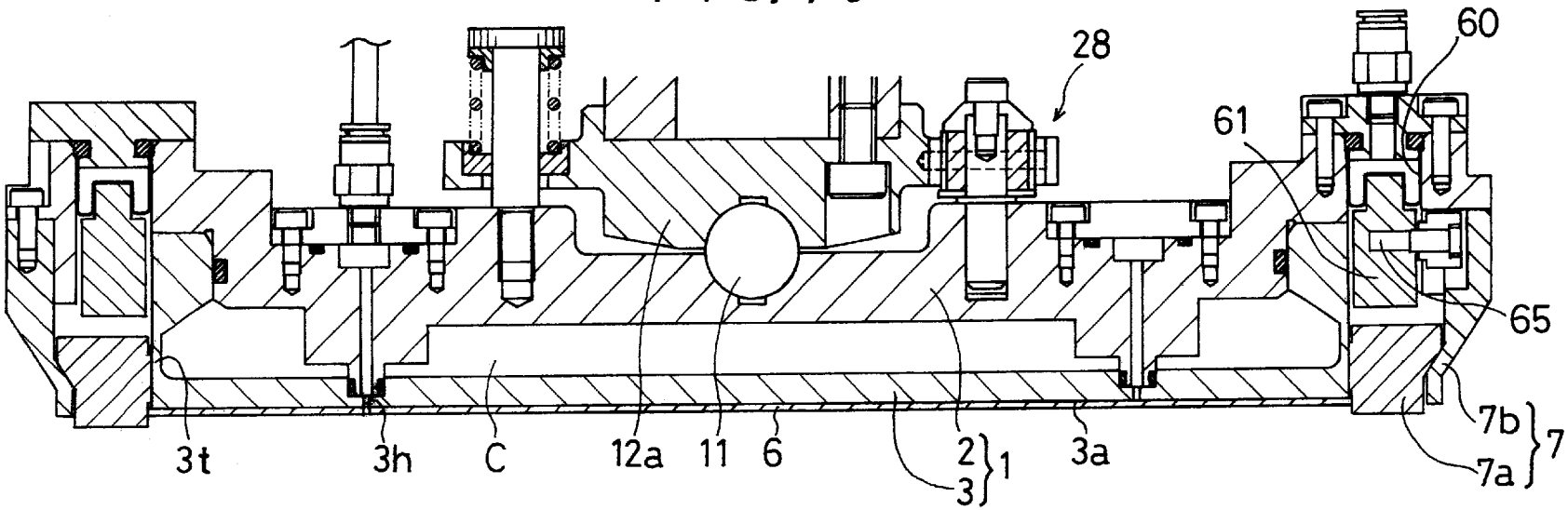
FIG. 10A is a cross-sectional view showing the polishing apparatus according to still other embodiment of the present invention.
Figure 10B:
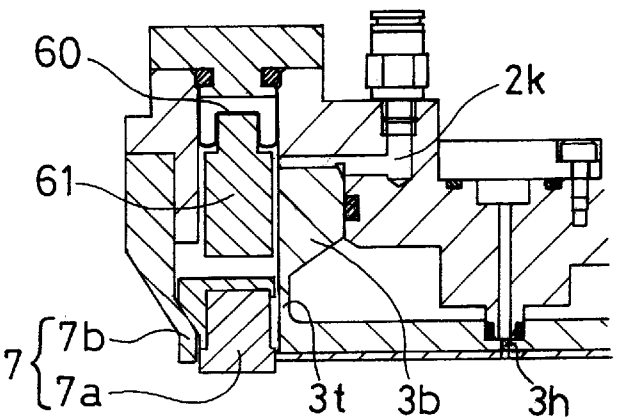
FIG. 10B is an enlarged cross-sectional view of the essential part of the polishing apparatus illustrated in FIG. 10A.

FIGS. 8 through 10 are illustrations for showing other embodiments of the polishing apparatus. FIGS. 8A, 9A, and 10A are cross-sectional views showing the structure of the essential part of the polishing apparatus. FIGS. 8B, 9B, and 10B are enlarged cross-sectional views of FIGS. 8A, 9A, and 10A, respectively.

In the embodiments illustrated in FIGS. 4 through 7, the fluid pressure bag 8 comprising an annular tube similar to an inner tube of a tire for pressing the retainer ring 7. However, in the case where the retainer ring 7 is worn when it is used for a long period of time, the fluid pressure bag 8 is elongated by the distance corresponding to the amount of wear of the retainer ring 7, and hence the retainer ring 7 is pressed against the polishing cloth 21 by the fluid pressure bag 8. In case of the fluid pressure bag 8 shown in FIGS. 5 and 7, the fluid pressure is consumed only for elongating the fluid pressure bag 8 itself. Even if the fluid pressure with equivalent magnitude is applied, substantially the same pressing force as the pressing force applied by the retainer ring 7 before wearing can no longer be obtained. Thus, the polishing characteristics of the peripheral portion of the semiconductor wafer varies with the passage of time during continuous processing of the semiconductor wafers, and hence it is difficult to obtain a stable polishing performance.

In order to solve the above problem, in the embodiments shown in FIGS. 8 through 10, a pressing mechanism for pressing the retainer ring 7 uses such a structure that a desired pressing force can be applied to the retainer ring without depending on an elongation of elastic material such as rubber.

In the embodiment shown in FIGS. 8A and 8B, a pair of seal rings 40A and 40B are provided in a groove defined between the attachment flange portion 2*a* of the top ring body 2 and the outer peripheral portion 3*b* of the holding plate 3. The lower seal ring 40A comprises a ring 41*a* for pressing the retainer ring 7, and a lip seal 42*a* for sealing a clearance between the ring 41*a* and the holding plate 3 and a clearance between the ring 41*a* and top ring body 2. The upper seal ring 40B comprises a ring 41*b* fixedly mounted on the attachment flange portion 2*a* of the top ring body 2, and a lip seal 42*b* for sealing a clearance between the ring 41*b* and the holding plate 3 and a clearance between the ring 41*b* and top ring body 2. A space 43 is defined between the upper seal ring 40A and the lower seal ring 40B. The space 43 is connected to the fluid source 5 (see FIG. 4) through a connector 44, a tube 23, and a regulator $R_2$ so that a pressurized fluid such as a pressurized air can be supplied to the space 43. Therefore, the pressing force provided by the ring 41*a* onto the retainer ring 7, i.e. the pressing force provided by the retainer ring 7 onto the polishing cloth 21 can be adjusted by adjusting the fluid pressure of the pressurized fluid to be delivered into the space 43 by means of the regulator $R_2$.

In the embodiment shown in FIGS. 8A and 8B, a communication hole 2*k* is provided in the attachment flange portion 2*a* of the top ring body 2 to supply a cleaning liquid such as deionized water (pure water) to the retainer ring 7 and components around the retainer ring 7. The retainer ring 7, and the components around the retainer ring 7 such as the upper and lower seal rings 40A and 40B are cleaned by the cleaning liquid delivered through a tube 46, a connector 47, and the communication hole 2*k*.

According to the embodiment shown in FIGS. 8A and 8B, the vertical movement of the seal ring 40A is not limited, differently from that of the embodiments shown in FIGS. 5 and 7. The seal ring 40A can press the retainer ring 7 under a desired pressing force even when the retainer ring 7 is worn.

In the embodiment shown in FIGS. 9A and 9B, a ring-type air cylinder 50 is provided in a groove formed between the attachment flange portion 2*a* of the top ring body 2 and the outer peripheral portion 3*b* of the holding plate 3. The ring-type air cylinder 50 comprises a ring-type cylinder 51, and a ring-type piston 52 vertically movably provided in the cylinder 51. A rubber ring 53 for sealing is fixed to the upper end of the ring-type piston 52. A space 54 is defined between the ring-type piston 52 and the rubber ring 53.

The space 54 is connected to the fluid source 5 (see FIG. 4) through a connector 44, a tube 23, and the regulator $R_2$. A pressurized fluid such as a pressurized air is supplied to the space 54. The pressing force provided by the ring-type piston 52 onto the retainer ring 7, i.e. the pressing force provided by the retainer ring 7 onto the polishing cloth 21 can be adjusted by adjusting the fluid pressure of the pressurized fluid to be delivered into the space 54 by means of the regulator $R_2$. FIG. 9B shows a cleaning mechanism having the same structure as that shown in FIG. 8B for cleaning the retainer ring 7 and the ring-type air cylinder 50.

According to the embodiment shown in FIGS. 9A and 9B, the vertical movement of the ring-type piston 52 is not limited, differently from that of the embodiments shown in FIGS. 5 and 7. The ring-type piston 52 can press the retainer ring 7 under a desired pressing force even when the retainer ring 7 is worn. Other structural and functional details of the polishing apparatus according to this embodiment are identical to those of the polishing apparatus according to the embodiment shown in FIGS. 8A and 8B.

In the embodiment shown in FIGS. 10A and 10B, a ring-shaped fluid pressure bag 60 is provided at the attachment flange portion 2*a* of the top ring body 2. A ring-type piston 61 contacts the fluid pressure bag 60, and a part of the ring-type piston 61 is embeded into the fluid pressure bag 60. The arrangement shown in FIG. 10 is a kind of ring-type air cylinder in which a pressing force is provided by the fluid pressure bag 60 onto the ring-type piston 61 by applying the fluid pressure to the fluid pressure bag 60 accomodated within the cylinder. The fluid pressure bag 60 has a space into which a pressurized fluid is supplied. The fluid pressure bag 60 presses the ring-type piston 61 not by its own expansion but by its own deformation caused by the fluid pressure, so that there is no variation of the pressing force due to the extension or expansion of the bag. This arrangement can dispense with a seal means such as a lip seal and reduce the hysterisis of the pressing force caused by the seal. A pin 65 is provided to allow the vertical movement of the ring-type piston 61, but to prevent the rotation of the ring-type piston 61. In this embodiment, the communication hole 2*k* for cleaning the retainer ring 7, the fluid pressure bag 60 and the ring-type piston 61 is formed radially inwardly of the fluid pressure bag 60 and the ring-type piston 61.

Figure 11:
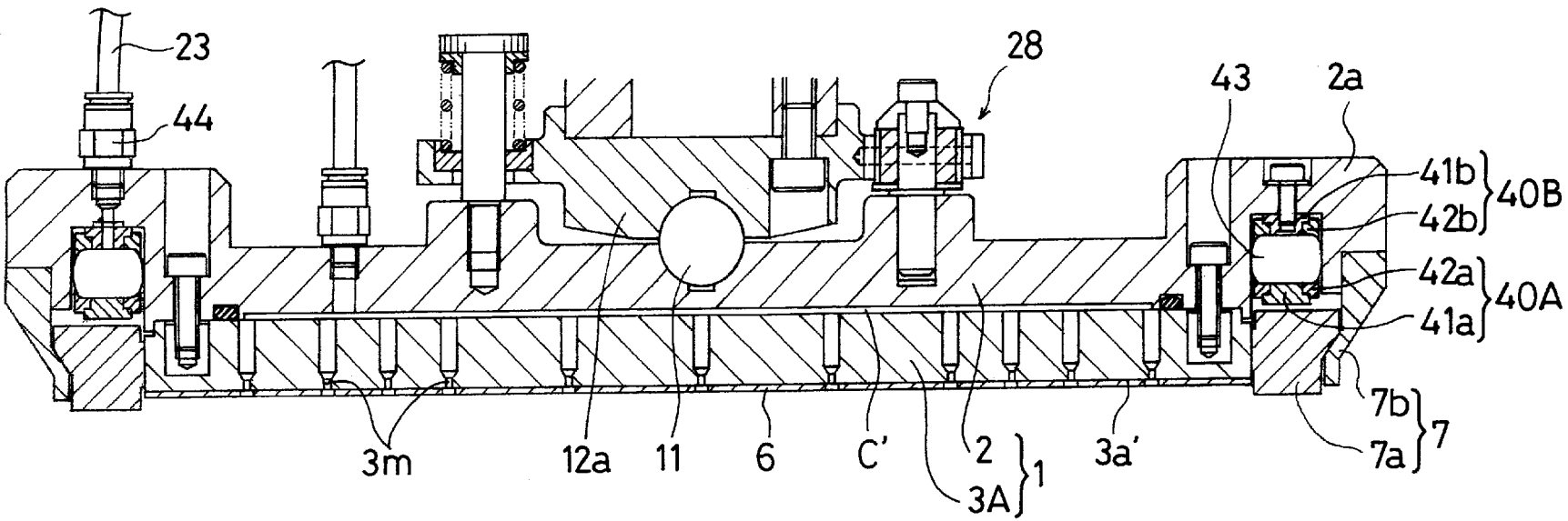
FIG. 11 is a cross-sectional view showing an embodiment in which a pressing mechanism for pressing a retainer ring shown in FIG. 8 is provided in a conventional top ring.
Figure 12:
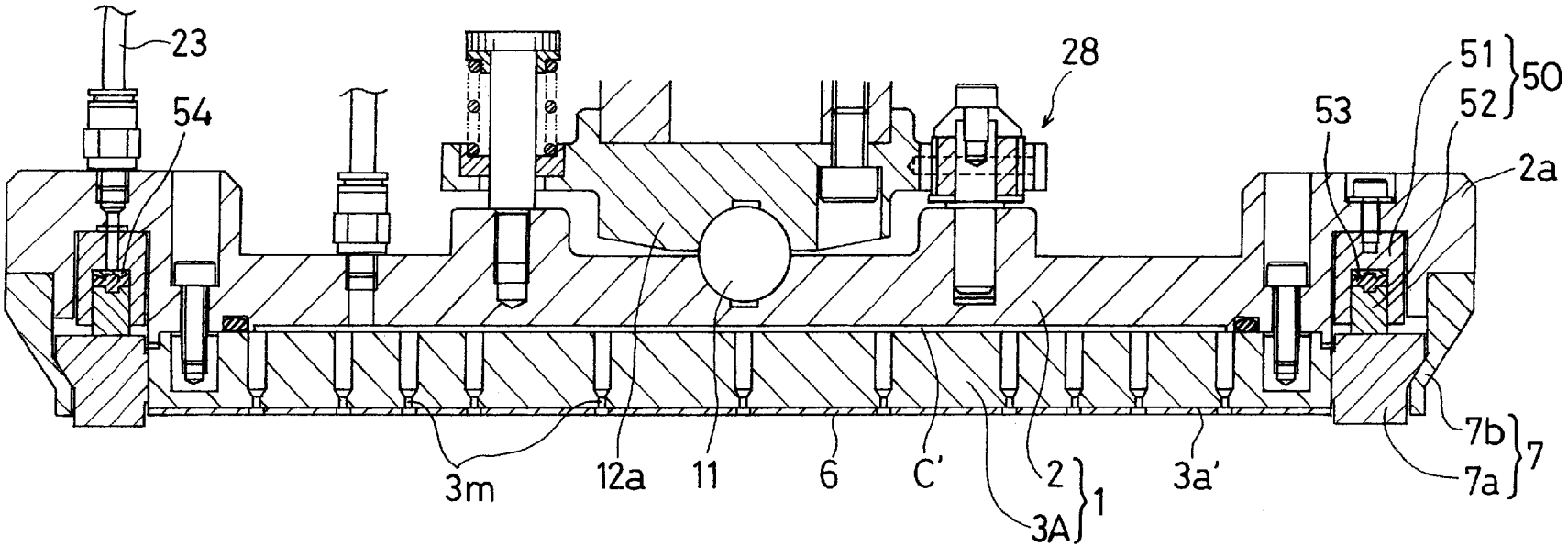
FIG. 12 is a cross-sectional view showing an embodiment in which a pressing mechanism for pressing a retainer ring shown in FIG. 9 is provided in a conventional top ring.
Figure 13:
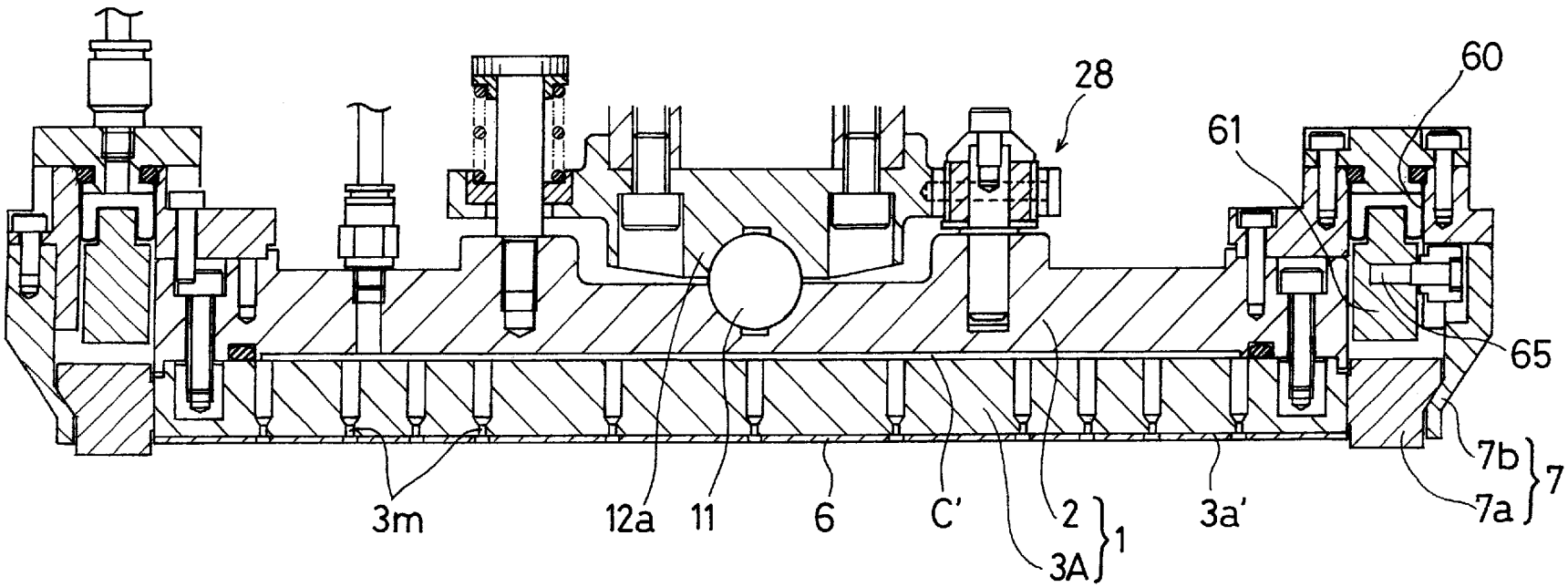
FIG. 13 is a cross-sectional view showing an embodiment in which a pressing mechanism for pressing a retainer ring shown in FIG. 10 is provided in a conventional top ring.

FIGS. 11 through 13 show embodiments in which a pressing mechanism for pressing a retainer ring shown in FIGS. 8 through 10 is provided in a conventional top ring having a wafer holding surface which is formed by high-rigid material such as ceramics and is not deformable.

In the embodiments shown in FIGS. 11 through 13, each of top rings 1 comprises a top ring body 2, and a holding plate 3A for holding an upper surface of the workpiece, to be polished, such as a semiconductor wafer 4 (see FIG. 4). The holding plate 3A is formed by high-rigid material such as ceramics, and a wafer holding surface 3*a*' is not deformable. An elastic pad 6 is attached to the lower surface of the holding plate 3A. A retainer ring (guide ring) 7 for holding the semiconductor wafer 4 on the lower surface, i.e. the wafer holding surface 3*a*' of the holding plate 3A is disposed around the top ring body 2.

A chamber C' is defined between the holding plate 3A and the top ring body 2, and this chamber C' is provided not for causing the holding plate 3A to be deformed but for supplying fluid to the lower surface of the holding plate 3A through communication holes 3*m* formed in the holding plate 3A. Specifically, by supplying a pressurized fluid such as a compressed air to the chamber C', the pressurized fluid is ejected from the wafer holding surface 3*a*' of the holding plate 3A to apply a backside pressure to the semiconductor wafer 4. By evacuating the interior of the chamber C', the semiconductor wafer 4 is held by the holding surface 3*a*' of the holding plate 3A under vacuum. Further, when the semiconductor wafer 4 is removed from the holding surface 3*a*', liquid such as pure water is supplied to the chamber C', and then ejected from the holding surface 3*a*' of the holding plate 3A.

The top rings shown in FIGS. 11 through 13 have a pressing mechanism for pressing the retainer ring shown in FIGS. 8 through 10, respectively, at the attachment flange portion 2*a* of the top ring body 2. That is, in the top ring shown in FIG. 11, the seal rings 40A and 40B shown in FIG. 8 are provided to press the retainer ring 7 against the polishing cloth 21 (see FIG. 4). In the top ring shown in FIG. 12, the ring-type air cylinder 50 shown in FIG. 9 is provided to press the retainer ring 7 against the polishing cloth 21. Further, in the top ring shown in FIG. 13, the fluid pressure bag 60 shown in FIG. 10 is provided to press the retainer ring 7 against the polishing cloth 21. Therefore, in the embodiments shown in FIGS. 11 through 13, even if the retainer ring 7 is worn, the pressing mechanism for pressing the retainer ring 7 can press the retainer ring 7 against the polishing cloth 21 under a desired pressing force.

Next, a polishing apparatus according to a second aspect of the present invention will be described with reference to FIGS. 14 through 19. The required performance of the top ring is to polish various films (layers) deposited on the semiconductor wafer uniformly over the entire surface of the semiconductor wafer. In this case, the surface of the semiconductor wafer can not be polished uniformly over the entire surface thereof depending on the performance of the polishing apparatus or the top ring. It is therefore necessary to control the pressing force applied to the semiconductor wafer locally.

Recently, the requirement of the users has changed from uniformizing the amount of material to be removed by polishing over the entire surface to planarizing the surface of the semiconductor wafer after polishing. This is due to the fact that the semiconductor wafer to be polished has a deposited film (layer) which is not flat over the entire surface thereof. The film (layer) has local areas in which the thickness of the film is thicker than that of other areas depending on the kind of film or the condition of deposition. For example, in some cases, the thickness of the film on the outer circumferential portion of the semiconductor wafer is larger than that on the central portion of the semiconductor wafer. In such cases, it is necessary to make the entire surface of the semiconductor wafer flat by applying a polishing pressure onto the thick area higher than that applied onto other area for thereby removing more material from the thick area.

In the top ring of diaphragm-type in which the wafer holding surface is deformable by the fluid pressure as shown in FIGS. 1 through 10, an elastic pad (backing film) is attached to the metallic holding plate constituting a diaphragm, and the semiconductor wafer is polished by applying a polishing pressure to the backside surface of the semiconductor wafer through the elastic pad. The semiconductor wafer is polished uniformly over the entire surface thereof while controlling the shape of the wafer pressing surface (the wafer holding surface) so as to be convex downwardly or upwardly by pressurizing the metallic diaphragm with the pressurized fluid. The profile of the polished wafer can be also controlled by partially pressing the semiconductor wafer intensively with the deformed diaphragm. However, as long as the elastic pad (backing film) is used, there are many unstable factors such as uneven quality of the backing film, variation of the modulus of elasticity with the passage of time due to its continuous operation, uneven modulus of elasticity within the surface due to difference of water absorption.

In the top ring of membrane-type in which the semiconductor wafer is pressed through an elastic membrane of rubber by the pressurized fluid, it is possible to apply uniform pressure to the backside surface of the semiconductor wafer through the elastic membrane. However, such top ring can apply uniform pressure onto the entire surface of the semiconductor wafer, but can not apply controlled pressure in local areas. It is therefore difficult to control the profile of the polished wafer partially.

According to the second aspect of the present invention, there is provided a top ring which has characteristics of the top ring of diaphragm-type shown in FIGS. 1 through 10, i.e. controllability of the distribution of pressure on the surface to be polished as well as characteristics of the top ring of membrane-type, i.e. applicability of uniform pressure onto the backside of the semiconductor wafer. Specifically, this top ring can apply controlled pressure partially onto the outer circumferential portion or the central portion of the semiconductor wafer, and apply uniform pressure onto the entire surface of other portion. Further, this top ring can control the region (width) of the outer circumferential portion or the central portion of the semiconductor wafer to which pressure is applied.

Figure 14:
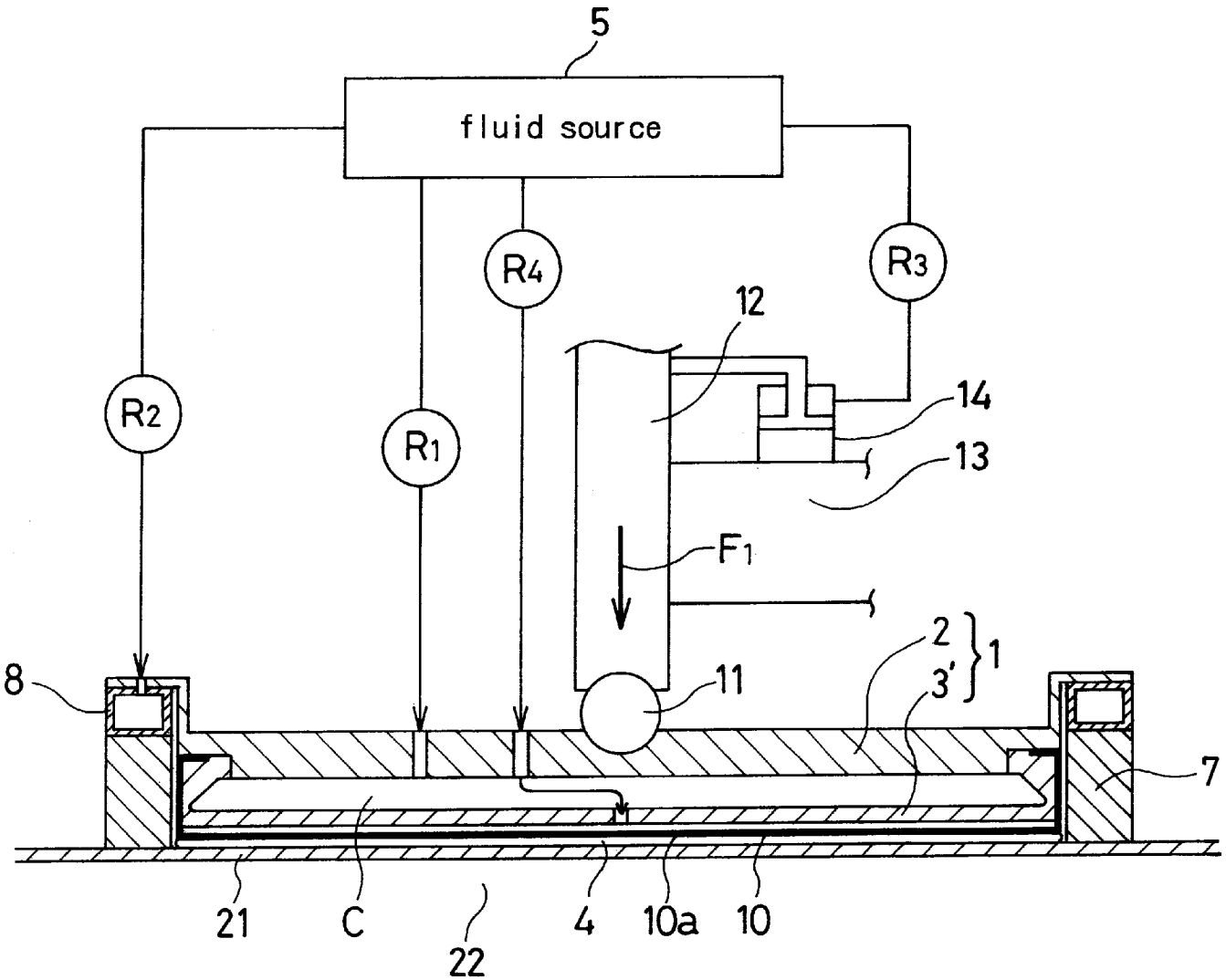
FIG. 14 is a schematic cross-sectional view showing the basic principles of the second aspect of the present invention.

FIG. 14 shows the basic principles of the second aspect of the present invention. In a top ring according to the second aspect of the present invention, an elastic membrane is added to the diaphragm-type top ring shown in FIG. 1. As shown in FIG. 14, the top ring 1 comprises a top ring body 2, a pressing plate 3' for pressing a workpiece, to be polished, such as a semiconductor wafer 4, and an elastic membrane 10 outwardly of the pressing plate 3'. The elastic membrane 10 is made of rubber having strength and durability such as ethylenepropylene rubber (EPDM), fluoro rubber, or silicon rubber. A space between the pressing plate 3' and the elastic membrane 10 is connected to the fluid source 5 through a fluid passage comprising a tube and a connector, and a regulator $R_4$. A chamber C is defined between the top ring body 2 and the pressing plate 3', and is connected to a fluid source 5 through a regulator $R_1$. A retainer ring (guide ring) 7 for holding the semiconductor wafer 4 on the lower surface, i.e. the wafer holding surface 10*a* of the elastic membrane 10 is disposed around the outer peripheral portion of the top ring 1. A fluid pressure bag 8 comprising an annular tube is provided between the retainer ring 7 and the top ring 1. The fluid pressure bag 8 is connected to the fluid source 5 through a regulator $R_2$. A turntable 22 having a polishing cloth 21 attached thereon is disposed below the top ring 1. The polishing cloth 21 constitutes a polishing surface which is brought in sliding contact with the semiconductor wafer for thereby polishing the semiconductor wafer.

The top ring 1 is connected to a top ring shaft 12 through a ball 11. The top ring shaft 12 is connected to a fluid pressure cylinder 14 fixedly mounted on a top ring head 13. The fluid pressure cylinder 14 serves as an actuator for moving the top ring 1 vertically, and is connected to the fluid source 5 through a regulator $R_3$.

In the above structure, by supplying a pressurized fluid such as a compressed air to the fluid pressure cylinder 14 from the fluid source 5, the top ring 1 presses the semiconductor wafer 4 to be polished against the polishing cloth 21 on the turntable 22 under a certain pressing force $F_1$ for thereby polishing the semiconductor wafer. The pressing force $F_1$ is variable by regulating the regulator $R_3$.

In the above structure, when a pressurized fluid such as a compressed air is not supplied to the chamber C from the fluid source 5, or the chamber C is not evacuated to create negative pressure therein by the fluid source 5, i.e. positive pressure or negative pressure is not applied to the diaphragm comprising the pressing plate 3', the top ring provides the same performance as the membrane-type top ring. Specifically, when positive pressure or negative pressure is not applied to the diaphragm, a pressurized fluid such as a compressed air is supplied to the space between the pressing plate 3' and the elastic membrane 10, and hence the top ring 1 presses the semiconductor wafer 4 against the polishing cloth 21 through a fluid pressure bag defined by the elastic membrane 10. Therefore, it is possible to apply uniform pressure onto the backside of the semiconductor wafer through the fluid pressure bag comprising the elastic membrane 10.

Figure 15:
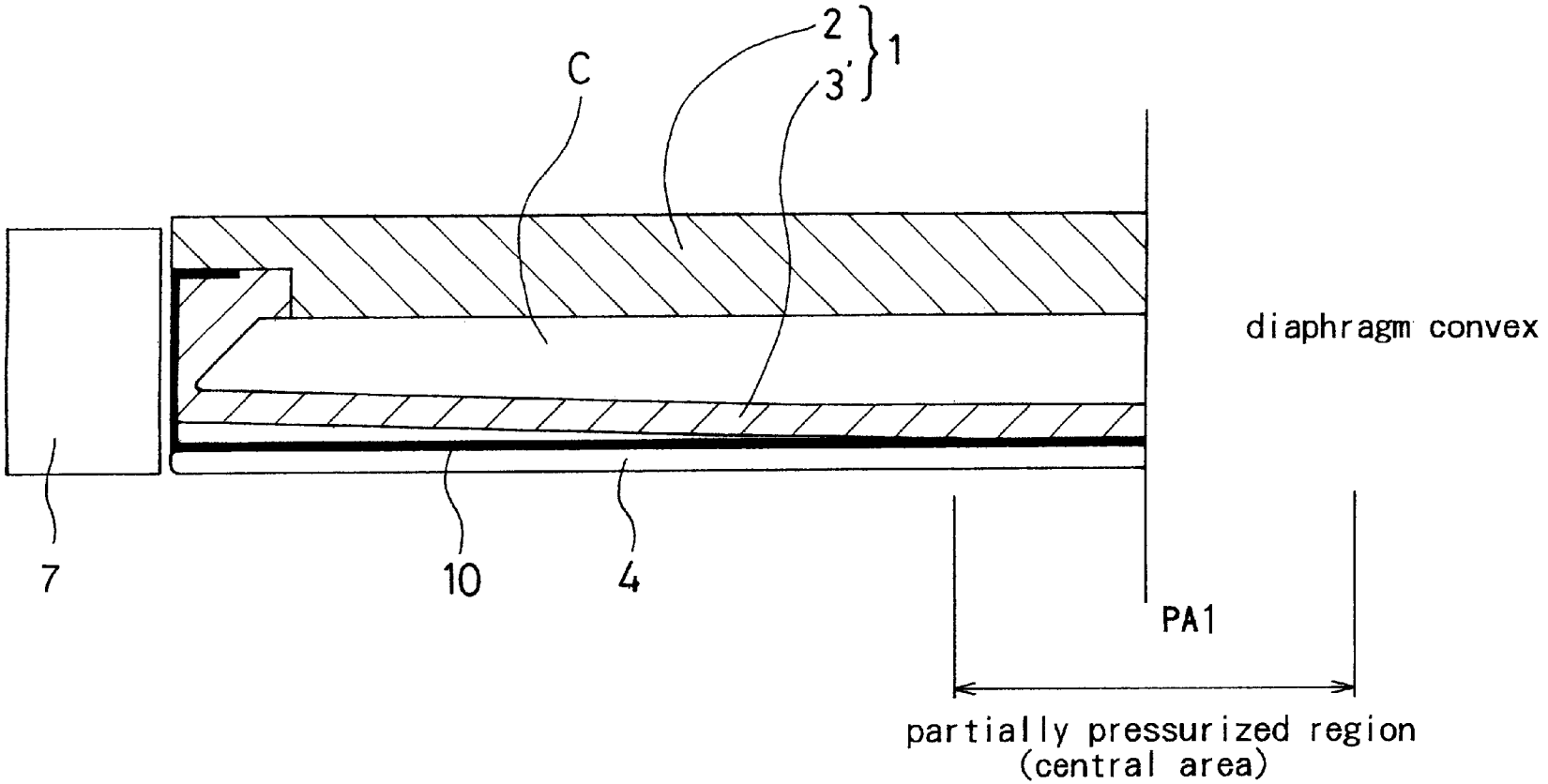
FIG. 15 is an enlarged schematic cross-sectional view showing the condition of the diaphragm comprising a pressing plate to which positive pressure is applied.

On the other hand, by supplying a pressurized fluid such as a compressed air to the chamber C from the fluid source 5 to apply positive pressure to the diaphragm comprising the pressing plate 3', as shown in FIG. 15, the pressing plate 3' is deformed so as to have a convex pressing surface, in a downward direction, whose maximum projecting height is about 0.1 mm. Therefore, the pressing plate (diaphragm) 3' is partially brought in contact with the elastic membrane 10. When the load or pressure of the top ring is increased, the central portion of the diaphragm (pressing plate) 3' presses the semiconductor wafer 4 only through the elastic membrane 10 without interposing fluid pressure formed by a fluid pressure bag. In other portion where the pressing plate 3' does not contact the elastic membrane 10, the elastic membrane 10 is pressurized uniformly by fluid pressure, and hence the semiconductor wafer 4 is pressed against the polishing cloth 21 under uniform pressure developed by the fluid pressure bag.

Figure 16:
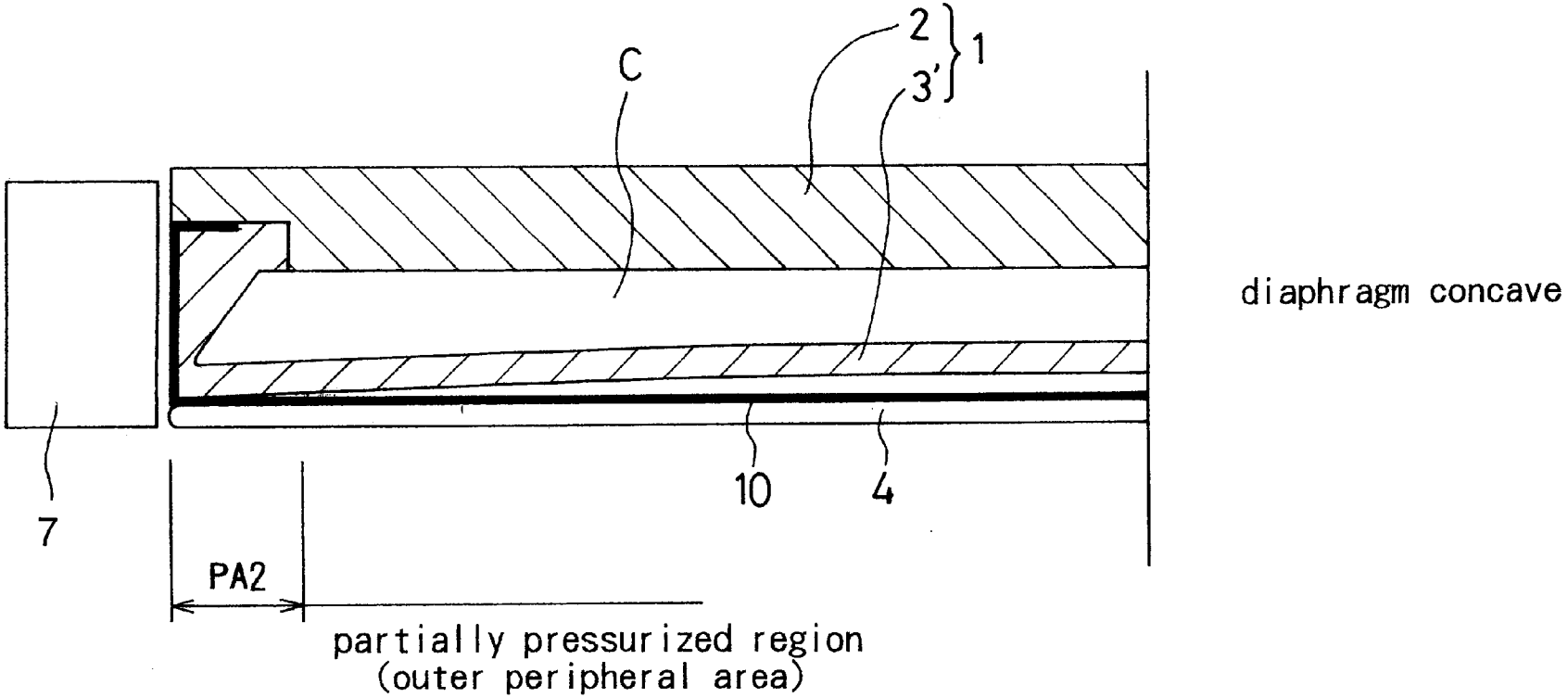
FIG. 16 is an enlarged schematic cross-sectional view showing the condition of the diaphragm comprising a pressing plate to which negative pressure is applied.

Further, by evacuating the chamber C by the fluid source 5 comprising a vacuum pump to apply negative pressure to the diaphragm comprising the pressing plate 3', as shown in FIG. 16, the pressing plate 3' is deformed so as to have a concave pressing surface, in a downward direction, whose maximum denting height is about 0.1 mm. Therefore, the pressing plate (diaphragm) 3' is partially brought in contact with the elastic membrane 10. When the load or pressure of the top ring is increased, the outer circumferential portion of the diaphragm (pressing plate) 3' presses the semiconductor wafer 4 only through the elastic membrane 10 without interposing fluid pressure formed by the fluid pressure bag. In other portion where the pressing plate 3' does not contact the elastic membrane 10, the elastic membrane 10 is pressurized uniformly by fluid pressure, and hence the semiconductor wafer 4 is pressed against the polishing cloth 21 under uniform pressure developed by the fluid pressure bag.

Figure 17A:
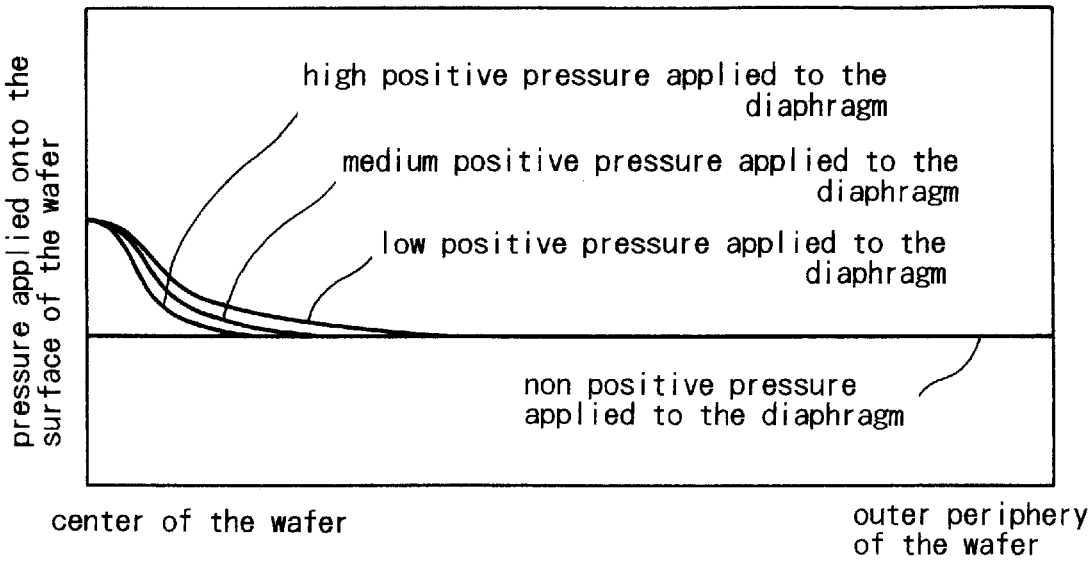
FIG. 17A is a graph showing the distribution of the pressure over the surface of the wafer when the diaphragm comprising the pressing plate is in the condition shown in FIG. 15.
Figure 17B:
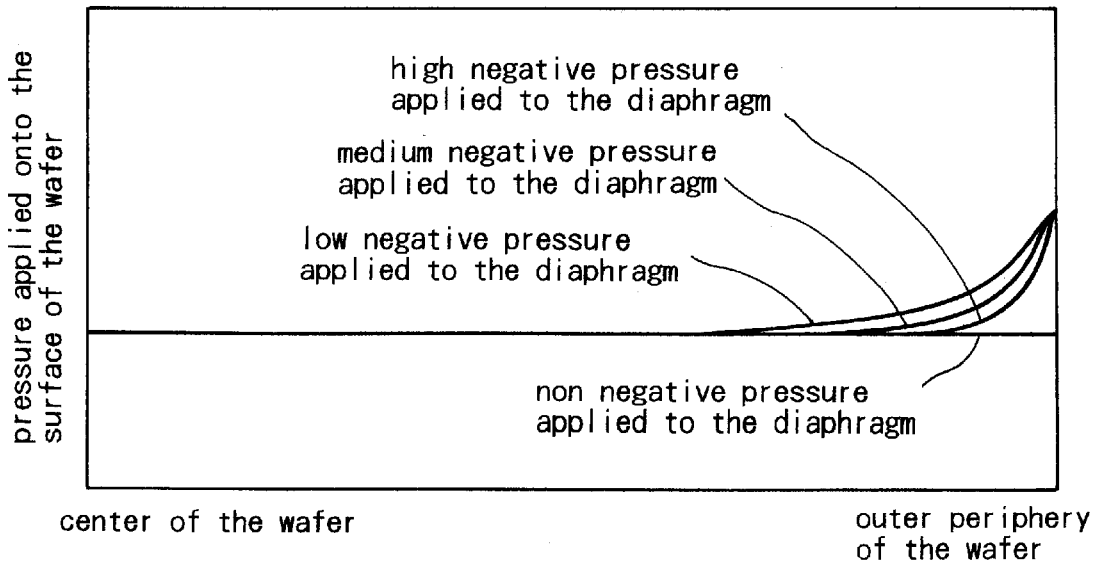
FIG. 17B is a graph showing the distribution of the pressure over the surface of the wafer when the diaphragm comprising the pressing plate is in the condition shown in FIG. 16.

FIGS. 17A and 17B are graphs showing the distribution of pressure applied to the semiconductor wafer obtained by controlling the pressure applied to the diaphragm. FIG. 17A represents the distribution of the pressure applied to the semiconductor wafer when the pressing plate (diaphragm) 3' is in the condition illustrated in FIG. 15, and FIG. 17B represents the distribution of the pressure applied to the semiconductor wafer when the pressing plate (diaphragm) 3' is in the condition illustrated in FIG. 16. In FIGS. 17A and 17B, the horizontal axis represents a distance from the center of the wafer to the outer periphery thereof, and the vertical axis represents pressure applied onto the surface of the wafer. As shown in FIGS. 17A and 17B, the distribution of the pressure applied onto the surface of the wafer at the central portion or the outer circumferential portion can be controlled by controlling the pressure applied to the pressing plate (the diaphragm) 3'. Further, as shown in FIGS. 17A and 17B, the region (width) in the central portion or the outer circumferential portion of the semiconductor wafer to which pressure is applied can be controlled by varying the magnitude of positive pressure or negative pressure to be applied to the pressing plate (the diaphragm) 3'. The partially pressurized region (width) is represented by PA1 and PA2 in FIGS. 15 and 16. These regions PA1 and PA2 can be wider or narrower by changing the magnitude of positive pressure or negative pressure applied to the pressing plate (the diaphragm) 3'.

Figure 18:
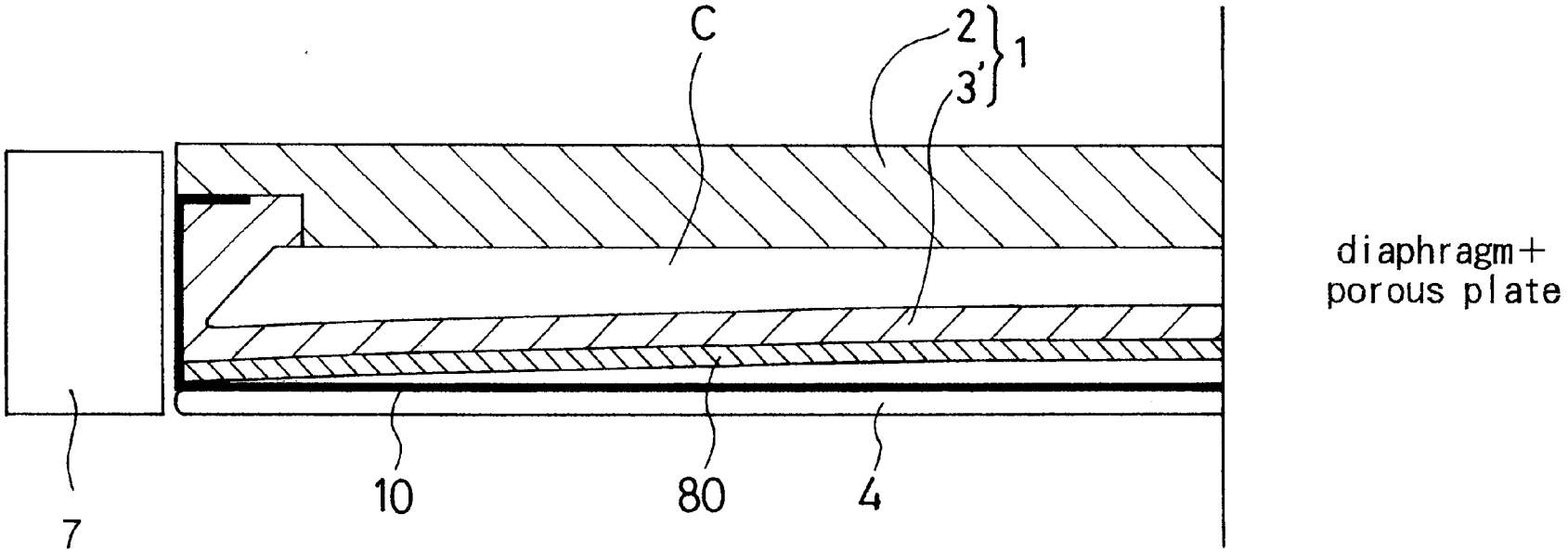
FIG. 18 is a schematic cross-sectional view showing the case in which a porous plate is provided on the lower surface of the pressing plate.

FIG. 18 shows an embodiment in which a porous plate 80 is provided on the lower surface of the pressing plate constituting the diaphragm. As shown in FIG. 18, by providing the porous plate 80 on the lower surface of the pressing plate 3', the pressurized fluid can be delivered into a clearance defined between the pressing plate (diaphragm) 3' and the elastic membrane 10 even if the clearance is very small. Therefore, the pressurized fluid can be spreaded over the entire surface of the elastic membrane 10 to allow the semiconductor wafer to be pressed uniformly over its entire surface.

Figure 19A:
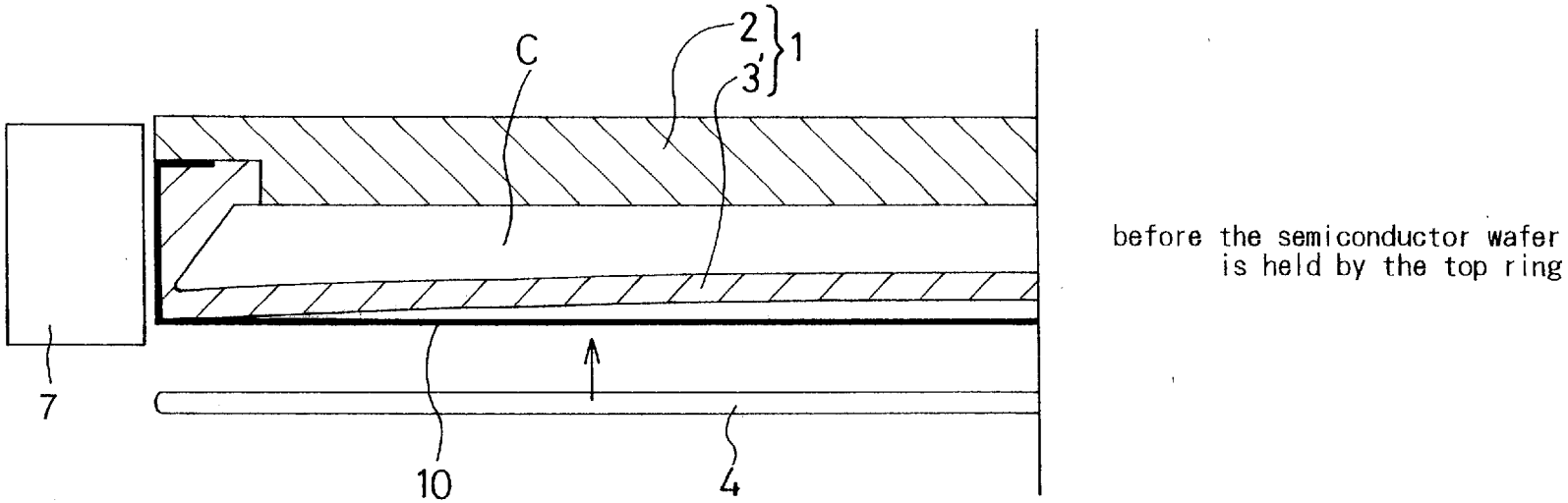
FIGS. 19A and 19B are a schematic cross-sectional view showing the operation of the top ring to hold the semiconductor wafer under vacuum.
Figure 19B:
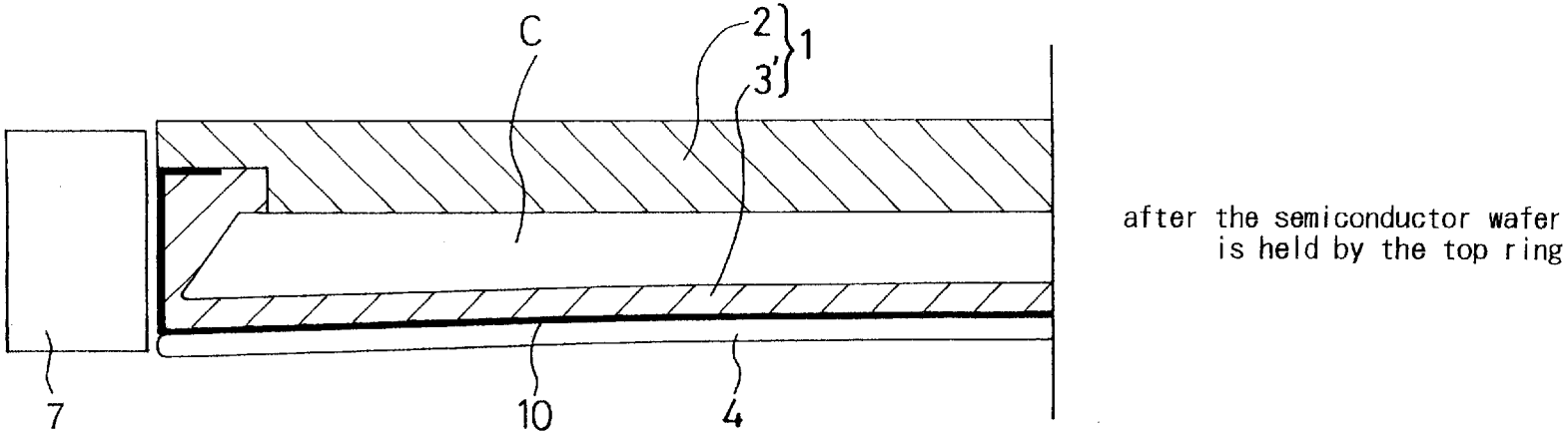

FIG. 19 is a schematic cross-sectional view showing the manner in which the top ring shown in FIGS. 14 through 18 holds the semiconductor wafer. FIG. 19A shows the state in which the semiconductor wafer is not held, and FIG. 19B shows the state in which the semiconductor wafer is held.

As shown in FIGS. 19A and 19B, the semiconductor wafer is held in the following manner: when the semiconductor wafer is not held by the top ring 1, the pressing plate (diaphragm) 3' is deformed to an upwardly concave configuration by applying negative pressure thereto, and the semiconductor wafer 4 is brought in contact with the elastic membrane 10, and then the space defined between the pressing plate (diaphragm) 3' and the elastic membrane 10 is evacuated to develop negative pressure therein. If the amount of deformation of the diaphragm is controlled so as to be failed within 0.1 mm, then the semiconductor wafer is prevented from being broken due to the deformation thereof even if the semiconductor wafer is deformed so as to conform to the surface of the diaphragm (the lower surface of the pressing plate 3'). Further, it is possible to control the force for attracting the semiconductor wafer by changing the magnitude of deformation of the diaphragm.

Figure 20:
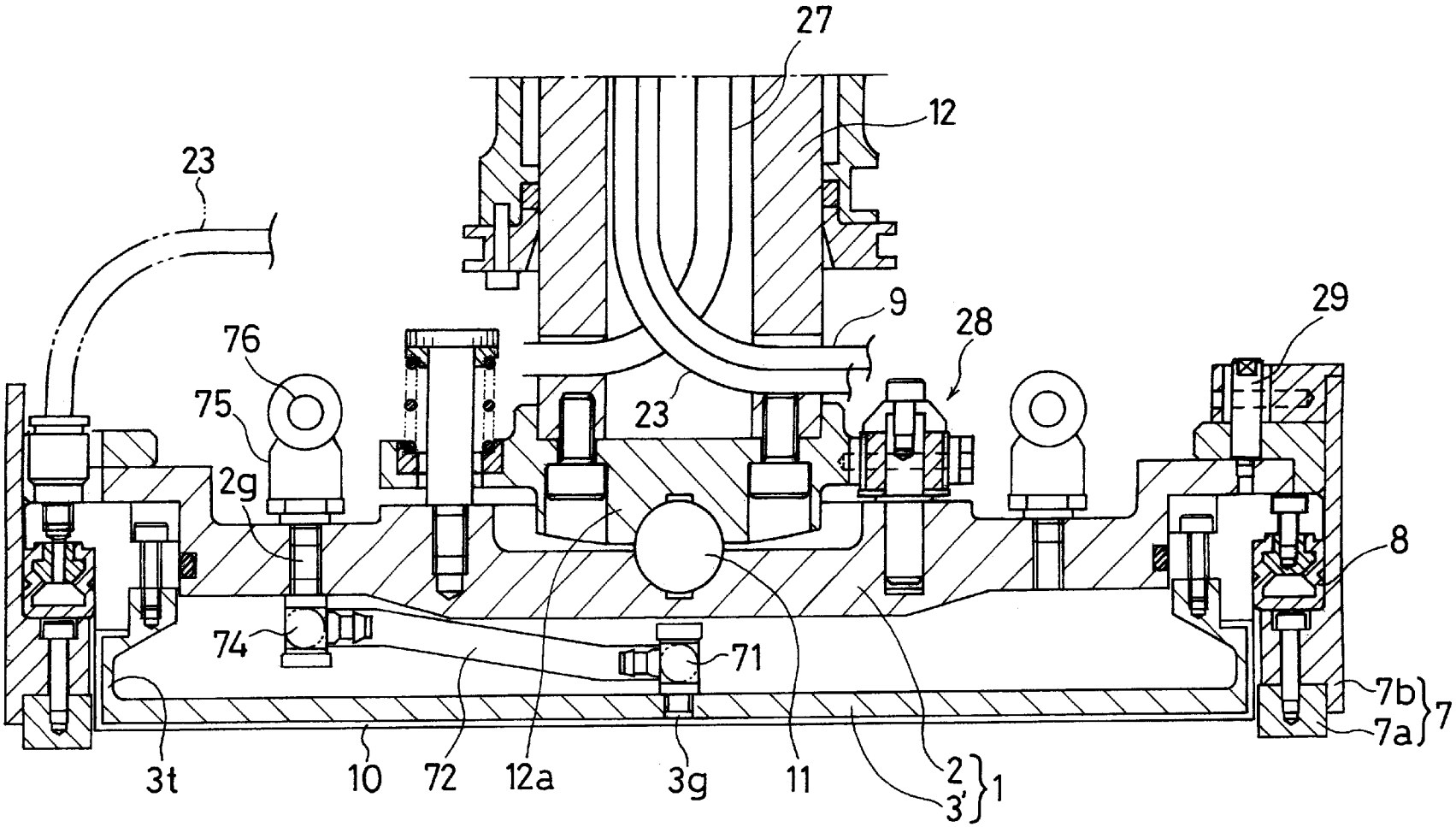
FIG. 20 is a detailed cross-sectional view showing the detailed structure according to the second aspect of the present invention.

FIG. 20 is a cross-sectional view showing a detailed structure of a polishing apparatus according to the second aspect of the present invention. In a top ring according to the second aspect of the present invention, an elastic membrane is added to the diaphragm-type top ring shown in FIG. 5. As shown in FIG. 20, the top ring 1 comprises a top ring body 2, a pressing plate 3' for pressing a workpiece, to be polished, such as a semiconductor wafer 4, and an elastic membrane 10 outwardly of the pressing plate 3'. An opening 3*g* is formed in the pressing plate 3', and a tube 72 is connected to the opening 3*g* through a connector 71. The tube 72 is connected to a fluid source 5 through a connector 74 fixed to the lower surface of the top ring body 2, an opening 2*g* formed in the top ring body 2, a connector 75 fixed to the upper surface of the top ring body 2, and a tube 76.

In the above structure, the pressurized fluid is delivered between the pressing plate 3' and the elastic membrane 10 through the opening 3*g*, the connectors 75, 74, and 71, and the tubes 76 and 72 to form a fluid pressure bag formed by the elastic membrane 10 on the lower side of the pressing plate 3'. That is, the connectors 75, 74 and 71, and the tubes 76 and 72 constitutes fluid passage for supplying a pressurized fluid from the fluid source 5 to the interior of the fluid pressure bag comprising the elastic membrane 10. The top ring of this embodiment exhibits characteristics of the top ring of diaphragm-type, i.e. controllability of the distribution of pressure on the surface to be polished as well as characteristics of the top ring of membrane-type, i.e. applicability of uniform pressure onto the backside of the semiconductor wafer. Specifically, this top ring can apply controlled pressure partially onto the outer circumferential portion or the central portion of the semiconductor wafer, and apply uniform pressure onto the entire surface of other portion. Further, this top ring can control the region (width) of the outer circumferential portion or the central portion of the semiconductor wafer to which pressure is applied.

In the present invention, the polishing surface on the turntable can be formed by the polishing cloth (polishing pad) or a fixed-abrasive. Examples of commercially available polishing cloth are SUBA 800, IC-1000, IC-1000/SUBA 400 (double layered cloth) manufactured by Rodel Products Corporation and Surfin xxx-5, and Surfin 000 manufactured by Fujimi Inc. The polishing cloth sold under the trade name SUBA 800, Surfin xxx-5, and Surfin 000 is made of non-woven fabric composed of fibers bound together by urethane resin, and the polishing cloth sold under the trade name IC-1000 is made of hard polyurethane form (single layered) which is porous and has minute recess or micropores in its surface.

The fixed-abrasive is formed into a plate shape by fixing abrasive particles in a binder. The polishing operation is performed by abrasive particles self-generated on the surface of the fixed-abrasive. The fixed-abrasive is composed of abrasive particles, binder and micropores. For example, the abrasive particles used in the fixed-abrasive are cerium oxide ($CeO_2$) having an average particle size of not more than 0.5 $\mu$m, and epoxy resin is used as the binder. The fixed-abrasive constitutes a hard polishing surface.

The fixed-abrasive includes not only a plate-type fixed-abrasive but also a double layered fixed-abrasive pad comprising a fixed-abrasive and a polishing pad having elasticity to which the fixed-abrasive is adhered. Another hard polishing surface can be provided by the above mentioned IC-1000.

The turntable to be employed in the present invention is not limited to the turntable of a type which rotates around the central axis thereof, and includes a table of scroll type in which any point on the table makes a circulative translational motion.

As described above, the present invention offers the following advantages:

The distribution of the pressing force of the workpiece is prevented from being nonuniform at the central portion or the peripheral portion of the workpiece during the polishing process, and the polishing pressures can be uniformized over the entire surface of the workpiece. Therefore, the central portion or the peripheral portion of the workpiece is prevented from being polished excessively or insufficiently. The entire surface of workpiece can thus be polished to a flat mirror finish. In the case where the present invention is applied to semiconductor manufacturing processes, the semiconductor devices can be polished to a high quality. Since the peripheral portion of the semiconductor wafer can be used as products, yields of the semiconductor devices can be increased.

In the case where there are demands for the removal of a larger or smaller thickness of material from the peripheral portion of the workpiece than from the inner region of the workpiece depending on the type of the workpiece such as a semiconductor wafer, the amount of the material removed from the peripheral portion of the workpiece can be intentionally increased or decreased. Further, the amount of the material removed from not only the peripheral portion of the workpiece but also the localized area (for example, central portion or outer circumferential portion) can be intentionally increased or decreased.

Further, according to the present invention, the top ring has characteristics of the top ring of diaphragm-type, i.e. controllability of the distribution of pressure on the surface to be polished as well as characteristics of the top ring of membrane-type, i.e. applicability of uniform pressure onto the backside of the workpiece. Specifically, this top ring can apply controlled pressure partially onto the outer circumferential portion or the central portion of the workpiece, and apply uniform pressure onto the entire surface of other portion. Further, this top ring can control the region (width) of the outer circumferential portion or the central portion of the workpiece to which pressure is applied.

Although certain preferred embodiments of the present invention have been shown and described in detail, it should be understood that various changes and modifications may be made therein without departing from the scope of the appended claims.

What is claimed is:

1. A method for polishing a workpiece, said method comprising:

holding a workpiece between a polishing surface of a turntable and a pressing surface of a top ring;

pressing the workpiece against said polishing surface through a fluid pressure bag provided between said pressing surface and the workpiece in such a state that said pressing surface for pressing the workpiece is deformed to a desired shape by fluid having variable pressure; and pressing a retainer ring for retaining the workpiece within said top ring against said polishing surface under a variable pressing force.

2. An apparatus for polishing a workpiece, said apparatus comprising:

a turntable having a polishing surface;

a top ring for holding a workpiece and pressing the workpiece against said polishing surface;

a pressing surface of said top ring for pressing the workpiece, said pressing surface being deformable by fluid having variable pressure;

a fluid pressure bag provided between said pressing surface and the workpiece; and a retainer ring for retaining the workpiece within said top ring, said retainer ring pressing said polishing surface under a variable pressing force.

3. An apparatus as claimed in claim 2, wherein said top ring comprises a pressing plate having said pressing surface, said pressing surface being deformed by supplying said fluid having said variable pressure into a chamber defined by said pressing plate.

4. An apparatus as claimed in claim 3, wherein an interior of said fluid pressure bag is connected to a fluid source through an opening formed in said pressing plate, and a fluid passage.

5. An apparatus as claimed in claim 3, further comprising a porous plate provided on said pressing plate having a number of pores for allowing said fluid to be spreaded over a surface of said fluid pressure bag.

6. An apparatus as claimed in claim 2, wherein said fluid has positive pressure or negative pressure.

7. An apparatus as claimed in claim 2, wherein said pressing force applied by said retainer ring is variable by supplying fluid having variable pressure.

8. An apparatus as claimed in claim 6, wherein said fluid pressure bag comprises an elastic membrane.

* * * * *

UNITED STATES PATENT AND TRADEMARK OFFICE

CERTIFICATE OF CORRECTION

PATENT NO. : 6,435,949 B1
DATED : August 20, 2002
INVENTOR(S) : Seiji Katsuoka et al.

It is certified that error appears in the above-identified patent and that said Letters Patent is hereby corrected as shown below:

Column 20,
Line 64, replace "as claimed in claim 6" with -- as claimed in claim 2 --.

Signed and Sealed this

Seventeenth Day of December, 2002

JAMES E. ROGAN
*Director of the United States Patent and Trademark Office*